US010280918B2

(12) United States Patent
Bergman et al.

(10) Patent No.: US 10,280,918 B2
(45) Date of Patent: May 7, 2019

(54) RECIPROCATING COMPRESSOR WITH VAPOR INJECTION SYSTEM

(71) Applicant: Emerson Climate Technologies, Inc., Sidney, OH (US)

(72) Inventors: Ernest R. Bergman, Yorkshire, OH (US); John P. Elson, Sidney, OH (US); Frank S. Wallis, Sidney, OH (US); Anthony L. Erb, Sidney, OH (US); Diane Belinda Patrizio, Piqua, OH (US); Thomas L. Girvin, II, Centerville, OH (US); Brian G. Schroeder, Sidney, OH (US); Michael R. Schultz Navara, Oakwood, OH (US); Adam Michael Blake, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 372 days.

(21) Appl. No.: 15/142,915

(22) Filed: Apr. 29, 2016

(65) Prior Publication Data

US 2016/0245278 A1 Aug. 25, 2016

Related U.S. Application Data

(63) Continuation of application No. 14/132,556, filed on Dec. 18, 2013, now abandoned.
(Continued)

(51) Int. Cl.
*F04B 49/22* (2006.01)
*F04B 1/04* (2006.01)
(Continued)

(52) U.S. Cl.
CPC ..... *F04B 49/22* (2013.01); *F04B 1/0413* (2013.01); *F04B 7/0057* (2013.01);
(Continued)

(58) Field of Classification Search
CPC .. F04B 1/0413; F04B 7/0057; F04B 39/0094; F04B 39/25; F04B 49/22; F04B 53/10;
(Continued)

(56) References Cited

U.S. PATENT DOCUMENTS 793,864 A 7/1905 Harris
1,661,148 A * 2/1928 Winkler ..... F04B 7/04 137/512.4
(Continued)

FOREIGN PATENT DOCUMENTS

CN 1432109 A 7/2003
CN 101238288 A 8/2008
(Continued)

OTHER PUBLICATIONS

Advisory Action regarding U.S. Appl. No. 14/132,556, dated May 14, 2015.
(Continued)

*Primary Examiner* — Patrick Hamo
*Assistant Examiner* — Joseph S. Herrmann
(74) *Attorney, Agent, or Firm* — Harness, Dickey & Pierce, P.L.C.

(57) ABSTRACT

A compressor may include a compression cylinder, a compression piston, a crankshaft, an injection bore, a position sensor, and a valve assembly. The compression piston is disposed within the compression cylinder and is operable to compress a vapor disposed within the compression cylinder from a suction pressure to a discharge pressure. The crankshaft is operable to cycle the compression piston within the compression cylinder. The injection bore may be in fluid communication with the compression cylinder and may be operable to selectively communicate intermediate-pressure vapor at a pressure between the suction pressure and said discharge pressure to the compression cylinder. The position
(Continued)

sensor may measure a rotational position of the crankshaft. The valve assembly may be associated with the injection bore. The valve assembly may be operable to control passage of fluid from the injection bore into the compression cylinder in response to data provided by the position sensor.

22 Claims, 23 Drawing Sheets

Related U.S. Application Data

(60) Provisional application No. 61/738,741, filed on Dec. 18, 2012.

(51) Int. Cl.

| | |
|---|---|
| ***F04B 7/00*** | (2006.01) |
| ***F04B 39/00*** | (2006.01) |
| ***F04B 39/12*** | (2006.01) |
| ***F04B 53/10*** | (2006.01) |
| ***F04B 53/14*** | (2006.01) |

(52) U.S. Cl.
CPC ..... *F04B 39/0094* (2013.01); *F04B 39/125* (2013.01); *F04B 53/10* (2013.01); *F04B 53/14* (2013.01)

(58) Field of Classification Search
CPC ..... F04B 53/14; F25B 49/022; F25B 2400/0409; F25B 2400/0411; F25B 2400/05; F25B 2600/022; F25B 2600/027
See application file for complete search history.

(56) References Cited

U.S. PATENT DOCUMENTS 1,937,019 A 11/1933 Hamill
1,969,076 A 8/1934 Hirsch
2,024,323 A 12/1935 Wyld
2,029,941 A 2/1936 Pokorney
2,033,437 A 3/1936 McCune
2,274,224 A 2/1942 Vickers
2,510,887 A 6/1950 Hanson
2,772,831 A 12/1956 Cotter
3,548,868 A 12/1970 Mullaney
3,622,251 A 11/1971 Allen
3,664,371 A 5/1972 Schneider
3,734,647 A * 5/1973 Sparks ..... F04B 7/04 417/269
3,848,422 A 11/1974 Schibbye
3,951,574 A 4/1976 Panuline
4,006,602 A * 2/1977 Fanberg ..... F04B 39/06 415/178
4,157,057 A 6/1979 Bailey
4,236,881 A 12/1980 Pfleger
4,303,376 A 12/1981 Siekmann
4,303,427 A 12/1981 Krieger
4,332,144 A * 6/1982 Shaw ..... F04B 49/225 62/235.1
4,470,774 A 9/1984 Chambers
4,477,233 A 10/1984 Schaefer
4,567,733 A 2/1986 Mecozzi
4,594,858 A 6/1986 Shaw
4,620,836 A 11/1986 Brandl
4,739,632 A 4/1988 Fry
4,787,211 A 11/1988 Shaw
4,834,032 A 5/1989 Brennan
4,910,972 A 3/1990 Jaster
4,918,942 A 4/1990 Jaster
4,938,029 A 7/1990 Shaw
4,947,655 A 8/1990 Shaw
4,966,010 A 10/1990 Jaster et al.
4,974,427 A 12/1990 Diab
5,049,040 A 9/1991 Diab et al.
5,056,328 A 10/1991 Jaster et al.
5,056,329 A 10/1991 Wilkinson
5,062,274 A 11/1991 Shaw
5,081,963 A 1/1992 Galbraith
5,094,085 A 3/1992 Irino
5,095,712 A * 3/1992 Narreau ..... F25B 1/10 62/113
5,106,278 A 4/1992 Terwilliger
5,203,857 A 4/1993 Terwilliger et al.
5,282,022 A 1/1994 Haruki et al.
5,284,426 A 2/1994 Strikis et al.
5,449,278 A 9/1995 Lin
5,511,389 A 4/1996 Bush et al.
5,547,347 A 8/1996 Sethna et al.
5,626,027 A 5/1997 Dormer et al.
5,647,731 A 7/1997 Onozawa
5,927,088 A 7/1999 Shaw
6,019,080 A 2/2000 LaGrone
6,089,830 A 7/2000 Harte et al.
6,120,266 A 9/2000 Teck
6,183,211 B1 2/2001 Wood
6,189,495 B1 2/2001 Tuckey et al.
6,302,659 B1 10/2001 Parker et al.
6,318,891 B1 11/2001 Haffner et al.
6,318,977 B1 * 11/2001 Kopko ..... F04B 39/0016 417/307
6,358,026 B1 3/2002 Palmore
6,450,788 B1 9/2002 Grabert
6,514,058 B1 2/2003 Chou
6,558,135 B1 5/2003 Wood
6,568,198 B1 5/2003 Tadano et al.
6,616,428 B2 9/2003 Ebara et al.
6,638,029 B2 10/2003 Kharsa
6,651,458 B1 11/2003 Ebara et al.
6,695,596 B2 2/2004 Oh et al.
6,718,781 B2 * 4/2004 Freund ..... F25B 49/02 62/199
6,732,542 B2 5/2004 Yamasaki et al.
6,748,754 B2 6/2004 Matsumoto et al.
6,758,170 B1 7/2004 Walden
6,769,267 B2 8/2004 Ebara et al.
6,792,910 B2 9/2004 Haman et al.
6,802,701 B2 10/2004 Noh et al.
6,824,367 B2 11/2004 Matsumoto et al.
6,835,052 B2 12/2004 Kim
6,892,545 B2 5/2005 Ishikawa et al.
6,905,318 B2 6/2005 Kouno et al.
6,907,746 B2 6/2005 Sato et al.
6,929,455 B2 8/2005 Dreiman et al.
6,931,866 B2 8/2005 Sato et al.
7,008,199 B2 3/2006 Matsumoto et al.
7,021,252 B2 4/2006 Warfel et al.
7,028,495 B2 4/2006 Ebara et al.
7,086,244 B2 8/2006 Yamasaki et al.
7,101,161 B2 9/2006 Matsumoto et al.
7,114,349 B2 10/2006 Lifson et al.
7,131,821 B2 11/2006 Matumoto et al.
7,147,442 B2 12/2006 Yeh
7,155,925 B2 1/2007 Yamasaki et al.
7,168,257 B2 1/2007 Matsumoto et al.
7,513,756 B2 4/2009 Aoki et al.
7,647,790 B2 1/2010 Ignatiev et al.
8,157,538 B2 4/2012 Wallis et al.
8,197,240 B2 6/2012 Obara et al.
8,257,065 B2 9/2012 Divisi
RE44,636 E 12/2013 Caillat
2002/0056366 A1 5/2002 Kleibrink
2003/0017067 A1 1/2003 Chou
2003/0059321 A1 3/2003 Ikegami et al.
2003/0082063 A1 5/2003 Noh et al.
2003/0145615 A1 8/2003 Sasaki et al.
2003/0165391 A1 9/2003 Kim
2004/0035377 A1 2/2004 Arao
2004/0118147 A1 6/2004 Sato et al.
2004/0211216 A1 10/2004 Yamasaki et al.
2005/0044866 A1 3/2005 Shaw et al.
2005/0072173 A1 4/2005 Yamasaki et al.
2005/0089413 A1 4/2005 Sato et al.
2005/0180869 A1 8/2005 Ursan et al.

(56) References Cited

U.S. PATENT DOCUMENTS

| | | | |
|---|---|---|---|
| 2005/0191193 | A1 | 9/2005 | Chou |
| 2005/0193967 | A1 | 9/2005 | Warfel et al. |
| 2006/0056981 | A1 | 3/2006 | Matumoto et al. |
| 2006/0056982 | A1 | 3/2006 | Matumoto et al. |
| 2006/0056983 | A1 | 3/2006 | Matumoto et al. |
| 2006/0110273 | A1 | 5/2006 | Shaull et al. |
| 2007/0077157 | A1 | 4/2007 | Chou |
| 2007/0234977 | A1 | 10/2007 | Thorpe |
| 2007/0243078 | A1 | 10/2007 | Schmidt |
| 2008/0011261 | A1 | 1/2008 | Chrisman et al. |
| 2008/0080995 | A1 | 4/2008 | Inoue |
| 2008/0156306 | A1 | 7/2008 | Cerreto et al. |
| 2008/0170953 | A1 | 7/2008 | Lund |
| 2009/0092511 | A1 | 4/2009 | Jiang |
| 2009/0097997 | A1 | 4/2009 | Suzuki et al. |
| 2009/0246045 | A1 | 10/2009 | Kathmann |
| 2009/0274569 | A1 | 11/2009 | Jansen |
| 2010/0189581 | A1 | 7/2010 | Wallis et al. |
| 2011/0070113 | A1 | 3/2011 | Mohamed |
| 2013/0004339 | A1 | 1/2013 | Eisfelder et al. |
| 2014/0170003 | A1 | 6/2014 | Bergman et al. |
| 2014/0170006 | A1 | 6/2014 | Bergman et al. |

FOREIGN PATENT DOCUMENTS

| | | | |
|---|---|---|---|
| CN | 101408176 | A | 4/2009 |
| CN | 101568725 | A | 10/2009 |
| CN | 101772643 | A | 7/2010 |
| CN | 101896721 | A | 11/2010 |
| CN | 101952595 | A | 1/2011 |
| CN | 102997524 | A | 3/2013 |
| DE | 102010033539 | A1 | 11/2011 |
| EP | 1413758 | A2 | 4/2004 |
| JP | S578381 | A | 1/1982 |
| JP | H04255581 | A | 9/1992 |
| JP | 2004239093 | A | 8/2004 |
| WO | WO-2007128713 | A1 | 11/2007 |
| WO | WO-2009021469 | A1 | 2/2009 |
| WO | WO-2009031125 | A2 | 3/2009 |
| WO | WO-2011121618 | A1 | 10/2011 |

OTHER PUBLICATIONS

Does the Voorhees-Principle Enhance the Efficiency of $CO_2$ Refrigeration Systems?—K. Lambers, J. Suss, J. Kohler, 7th IIR Gustav Lorentzen Conference on Natural Working Fluids, Trondheim, Norway, May 28-31, 2006, 8 Pages.

Final Office Action regarding U.S. Appl. No. 14/132,556, dated Mar. 5, 2015.

International Search Report regarding Application No. PCT/US2013/076083, dated Apr. 8, 2014.

Non-Final Office Action regarding U.S. Appl. No. 14/132,556, dated Nov. 5, 2014.

Office Action regarding U.S. Appl. No. 14/132,490, dated Dec. 22, 2015.

Office Action regarding U.S. Appl. No. 14/132,556, dated Aug. 27, 2015.

Office Action regarding U.S. Appl. No. 14/132,556, dated Jan. 29, 2016.

Written Opinion of the International Searching Authority regarding Application No. PCT/US2013/076083, dated Apr. 8, 2014.

Office Action regarding U.S. Appl. No. 14/132,490, dated Nov. 3, 2017.

"Port in Mechanical Engineering." Collins English Dictionary. 2017.

"Isentropic and Volumetric Efficiencies for Compressors with Economizer Port," Klaus Jurgen Lambers, International Compressor Engineering Conference, Paper 1920 (2008). http://docs.lib.purdue.edu/icec/1920.

"Port Optimization of a Voorhees Modified CO2 Compressor Using Indicator Diagram Analysis", Klaus Lambers, International Compressor Engineering Conference, Paper 1733 (2006). http://docs.lib.purdue.edu/icec/1733.

European Patent Office Communication regarding Application No. 13864379.6 dated Aug. 1, 2016.

Office Action regarding U.S. Appl. No. 14/132,490, dated Jun. 17, 2016.

Office Action regarding Chinese Patent Application No. 201380070961.3, dated Jun. 2, 2016. Translation provided by Unitalen Attorneys at Law.

Office Action regarding U.S. Appl. No. 14/132,490, dated Mar. 16, 2018.

Office Action regarding Chinese Patent Application No. 201710090053.0, dated Jul. 20, 2018. Translation provided by Unitalen Attorneys at Law.

Office Action regarding Chinese Patent Application No. 201710090389.7, dated Aug. 1, 2018. Translation provided by Unitalen Attorneys at Law.

Office Action regarding U.S. Appl. No. 14/132,490, dated May 5, 2017.

Office Action regarding U.S. Appl. No. 14/132,490, dated Dec. 22, 2016.

Search Report regarding European Patent Application No. 13864379.6, dated Dec. 19, 2016.

Klaus Jürgen Lambers. "Isentropic and Volumetric Efficiencies for Compressors with Economizer Port." International Compressor Engineering Conference, School of Mechanical Engineering. Purdue University. Jul. 14-17, 2008.

Office Action regarding U.S. Appl. No. 14/132,490, dated Nov. 9, 2018.

* cited by examiner

RECIPROCATING COMPRESSOR WITH VAPOR INJECTION SYSTEM

CROSS-REFERENCE TO RELATED APPLICATIONS

This application is a continuation of U.S. patent application Ser. No. 14/132,556, filed on Dec. 18, 2013, which claims the benefit of U.S. Provisional Application No. 61/738,741, filed on Dec. 18, 2012. The entire disclosures of the above applications are incorporated herein by reference.

FIELD

The present disclosure relates to reciprocating compressors and more particularly to a reciprocating compressor incorporating a fluid-injection system.

BACKGROUND

This section provides background information related to the present disclosure which is not necessarily prior art.

Reciprocating compressors typically include a compressor body housing a drive motor and one or more piston-cylinder arrangements. In operation, the drive motor imparts a force on each piston to move the pistons within and relative to respective cylinders. In so doing, a pressure of working fluid disposed within the cylinders is increased.

Conventional reciprocating compressors may be used in refrigeration systems such as heating, ventilation, and air conditioning systems (HVAC) to circulate a refrigerant amongst the various components of the refrigeration system. For example, a reciprocating compressor may receive suction-pressure, gaseous refrigerant from an evaporator and may elevate the pressure from suction pressure to discharge pressure. The discharge-pressure, gaseous refrigerant may exit the compressor and encounter a condenser to allow the refrigerant to change phase from a gas to a liquid. The liquid refrigerant may then be expanded via an expansion valve prior to returning to the evaporator where the cycle begins anew.

In the foregoing refrigeration system, the compressor requires electricity in order to drive the motor and compress refrigerant within the system from suction pressure to discharge pressure. As such, the amount of energy consumed by the compressor directly impacts the costs associated with operating the refrigeration system. Conventional compressors are therefore typically controlled to minimize energy consumption while still providing sufficient discharge-pressure refrigerant to the system to satisfy a cooling and/or heating demand.

Compressor capacity and, thus, the energy consumed by a reciprocating compressor during operation may be controlled by employing so-called "blocked-suction modulation." Controlling compressor capacity via blocked-suction modulation typically involves starving the compressor of suction-pressure, gaseous refrigerant at times when a low volume of discharge-pressure refrigerant is required by the refrigeration system and allowing suction-pressure, gaseous refrigerant to freely flow into the compressor at times when a high volume of discharge-pressure refrigerant is required by the refrigeration system. Generally speaking, a low volume of discharge-pressure refrigerant is required at times when the load experienced by the refrigeration system is reduced and a high volume of discharge-pressure refrigerant is required at times when the load experienced by the refrigeration system is increased.

Controlling a reciprocating compressor via blocked-suction modulation reduces the energy consumption of the compressor during operation by reducing the load on the compressor to approximately only that which is required to meet system demand. However, conventional reciprocating compressors do not typically include a fluid-injection system such as a vapor-injection system or a liquid-injection system. As a result, conventional reciprocating compressor capacity is typically limited to the gains experienced via implementation of blocked-suction modulation and/or via a variable-speed drive.

SUMMARY

This section provides a general summary of the disclosure, and is not a comprehensive disclosure of its full scope or all of its features.

A compressor assembly is provided and may include a compression cylinder and a compression piston disposed within the compression cylinder that compresses a vapor disposed within the compression cylinder from a suction pressure to a discharge pressure. The compressor assembly may additionally include a crankshaft that cycles the compression piston within the compression cylinder and an injection port in fluid communication with the compression cylinder that selectively communicates intermediate-pressure vapor at a pressure between the suction pressure vapor and the discharge pressure vapor to the compression cylinder. The injection port may communicate the intermediate-pressure vapor to the compression cylinder when the compression piston exposes the injection port and may be prevented from communicating the intermediate-pressure vapor to the compression cylinder when the compression piston blocks the injection port.

In another configuration, a compressor assembly is provided and may include a compression cylinder and a compression piston disposed within the compression cylinder that compresses a vapor disposed within the compression cylinder from a suction pressure to a discharge pressure. The compression piston may be movable within the compression cylinder between a top dead center (TDC) position and a bottom dead center (BDC) position by a crankshaft that cycles the compression piston within the compression cylinder. An injection port may be in fluid communication with the compression cylinder and may selectively communicate intermediate-pressure vapor at a pressure between the suction pressure vapor and the discharge pressure vapor to the compression cylinder. The injection port may be exposed by the compression piston when the compression piston is approaching the BDC position to permit communication of the inter-mediate pressure vapor into the compression cylinder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
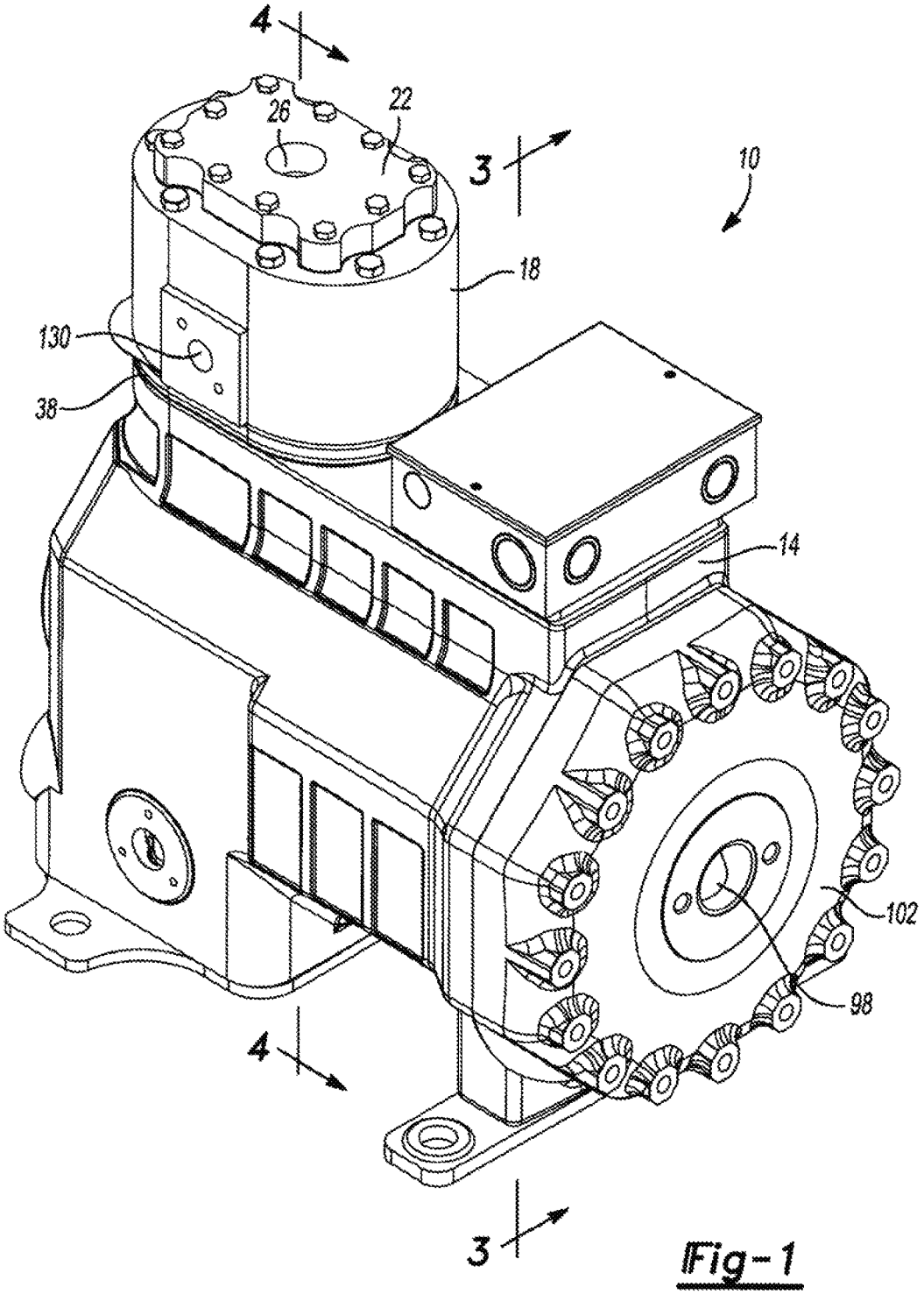
FIG. 1 is a perspective view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
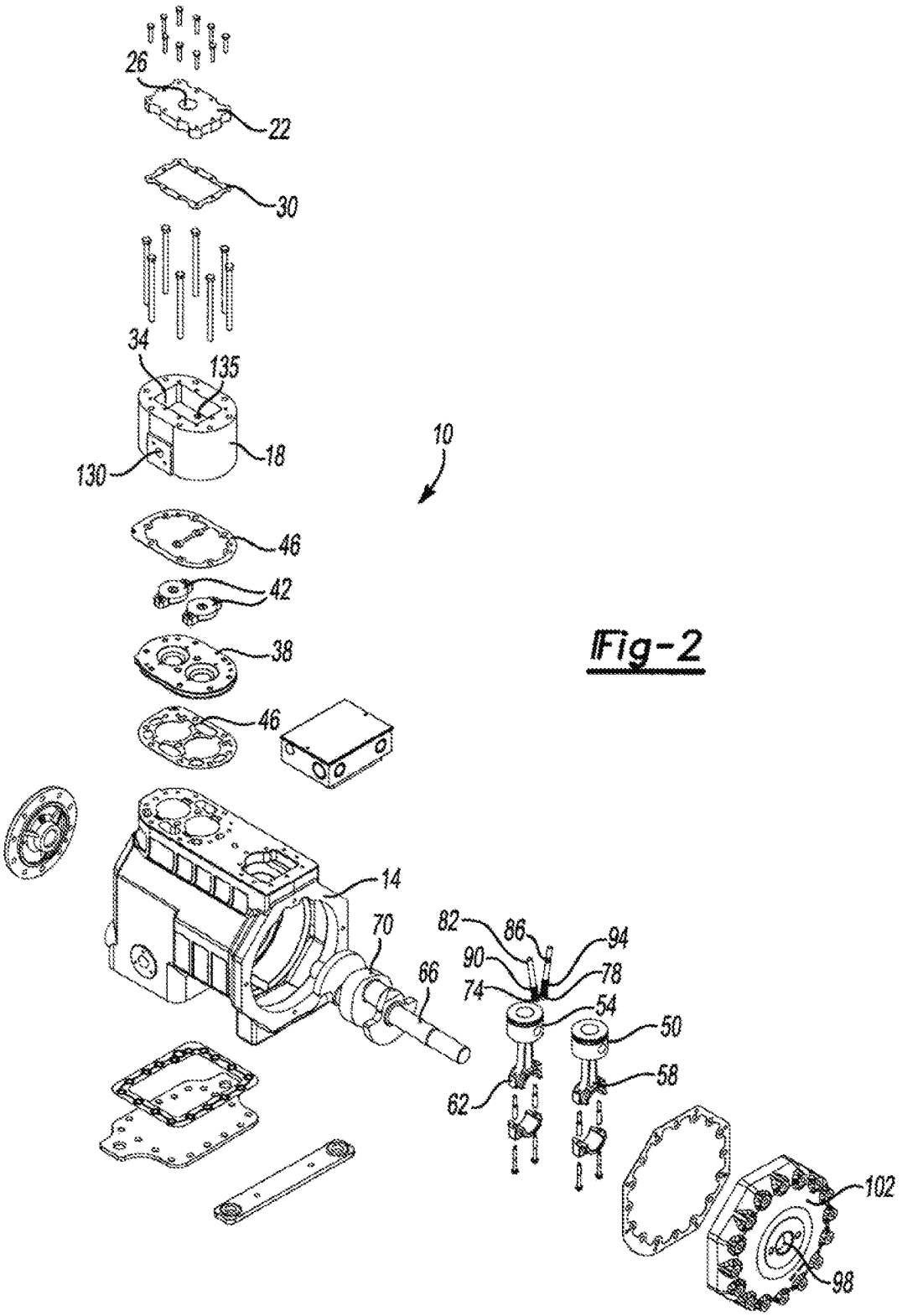
FIG. 2 is an exploded view of the compressor of FIG. 1.
Figure 3:
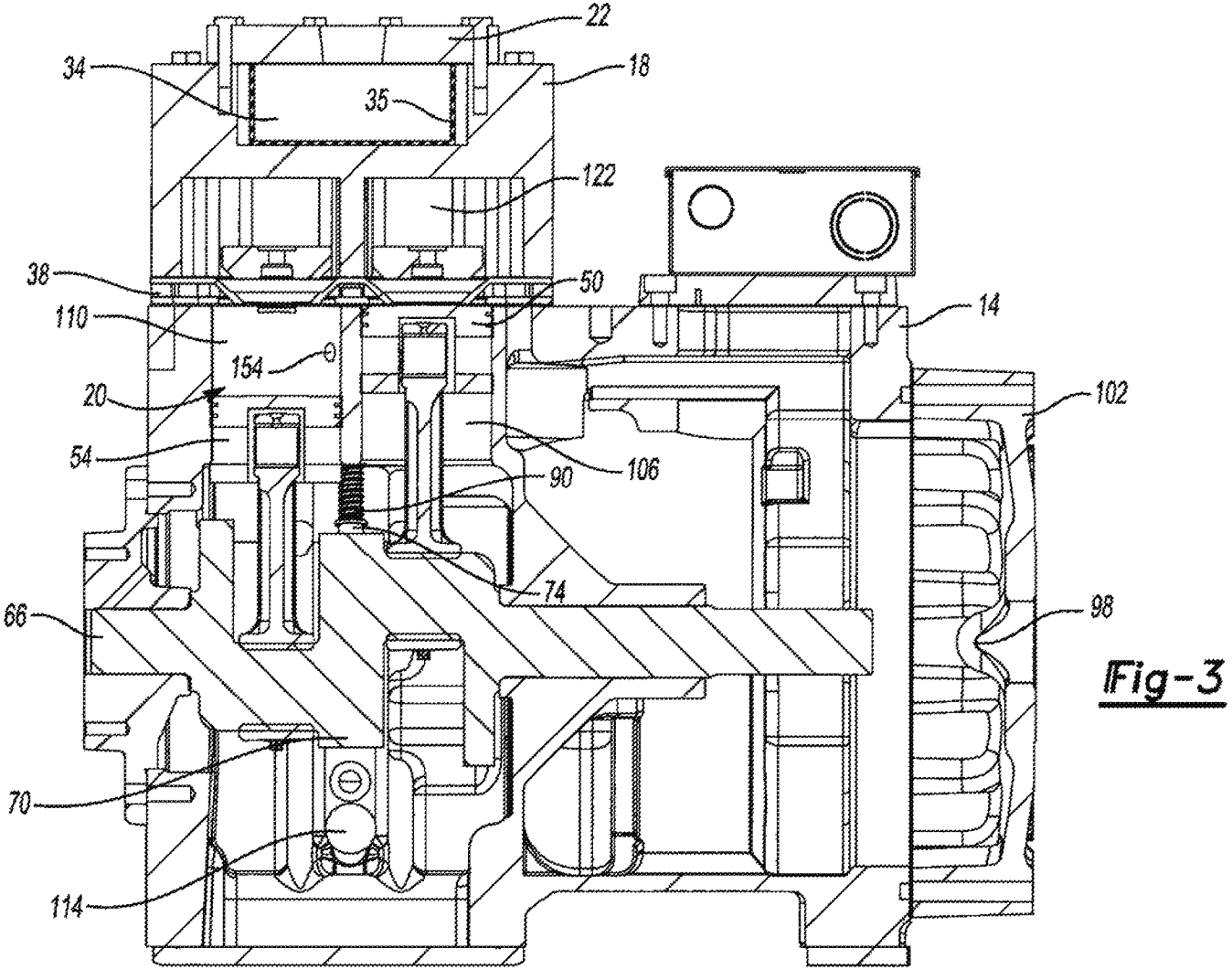
FIG. 3 is a cross-sectional view of the compressor of FIG. 1 taken along line 3-3.

With initial reference to FIGS. 1-3, a reciprocating compressor assembly 10 is provided and may include a compressor housing 14 and a cylinder head 18. The compressor housing 14 and cylinder head 18 may contain a compression mechanism 20 that selectively compresses a fluid from a suction pressure to a discharge pressure to cause the fluid to circulate amongst the various components of a refrigeration system.

The cylinder head 18 may include a top plate 22 having an inlet port 26, a top plate gasket 30, and a vapor-storage plenum 34. The cylinder head 18 may be incorporated into the compressor housing 14 by a valve plate 38 that includes valve retainers 42 and one or more gaskets 46 that serve to seal the cylinder head 18 and compressor housing 14 from outside contaminants.

The compression mechanism 20 may include first and second pistons 50, 54 that are located within the compressor housing 14 and are reciprocally movable in linear directions by respective connecting rods 58, 62. The connecting rods 58, 62 are disposed between the respective pistons 50, 54 and a crankshaft 66 to allow a rotational force applied to the crankshaft 66 to be transmitted to the pistons 50, 54. While the compressor assembly 10 is shown and described as including two pistons 50, 54, the compressor assembly 10 could include fewer or more pistons.

Figure 4:
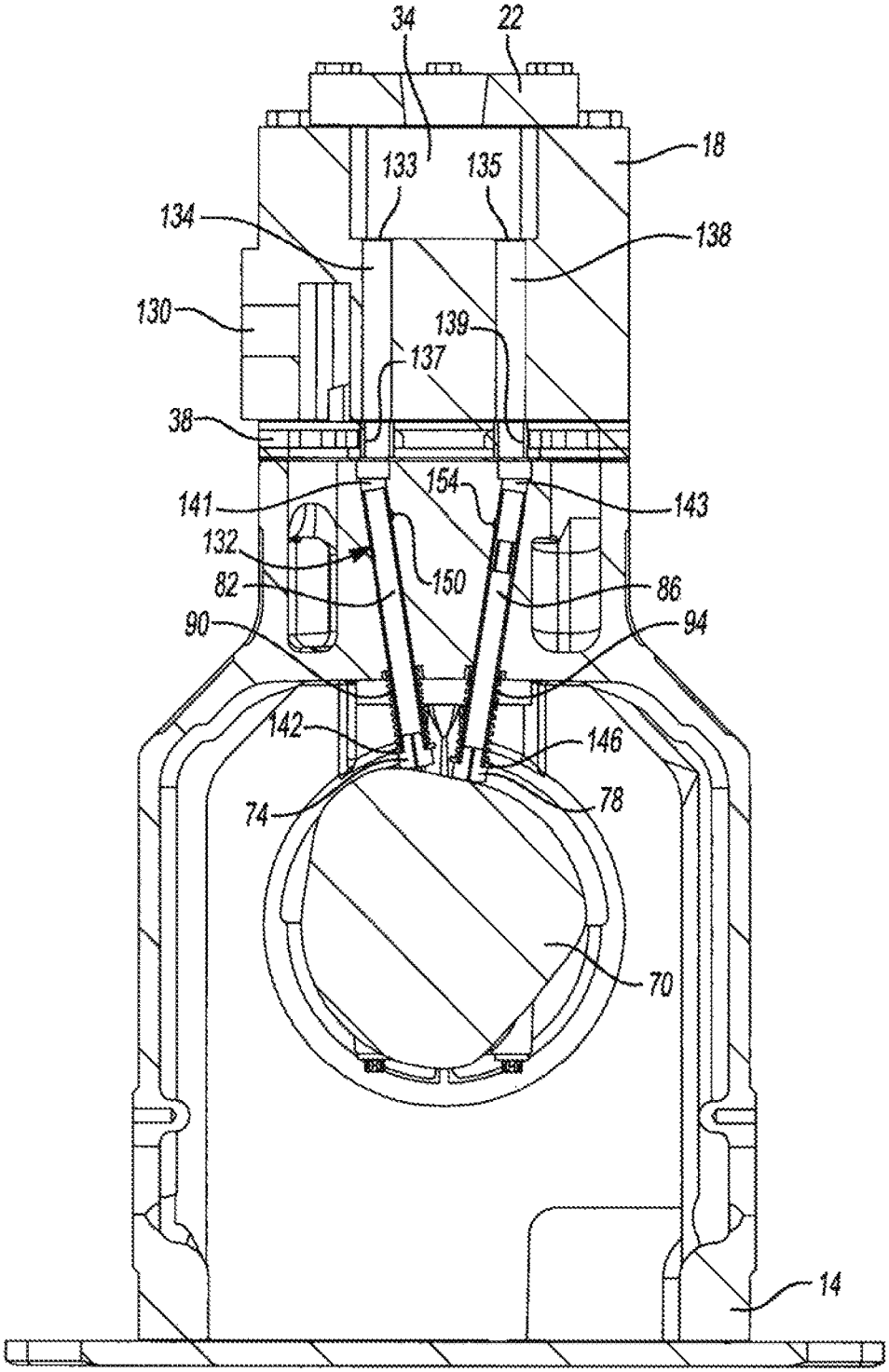
FIG. 4 is a cross-sectional view of the compressor of FIG. 1 taken along line 4-4.

The crankshaft 66 includes a cam profile 70 for controlling first and second followers 74, 78. The first and second followers 74, 78 are fixed for movement with respective cam pistons 82, 86 and are biased into engagement with the cam profile 70 of the crankshaft 66 via a respective spring 90, 94 (FIG. 4).

In operation, gaseous fluid (such as a refrigerant) is compressed in the compressor assembly 10 from a suction pressure to a discharge pressure. The refrigerant initially passes through a suction inlet port 98 formed in an end cap 102 of the compressor assembly 10 and enters the housing 14 in a low-pressure, gaseous form (i.e., at suction pressure). As described, the compressor assembly 10 is a so-called "low-side" compressor, as the suction-pressure vapor that enters the compressor housing 14 is permitted to fill an inner volume of the housing 14.

Once in the housing 14, the refrigerant may be drawn into first and second cylinders 106, 110 for compression. Specifically, when the first and second pistons 50, 54 are cycled within the respective cylinders 106, 110—due to rotation of the crankshaft 66 relative to the housing 14—the refrigerant is drawn from the interior volume of the housing 14 and into the first and second cylinders 106, 110. The refrigerant is then compressed within each cylinder 106, 110 from suction pressure to discharge pressure as the pistons 50, 54 are moved within and relative to each cylinder 106, 110. In other examples, there may be a single cylinder 106 or there may be any other number of cylinders in the housing 14 to accommodate the number of pistons 50, 54.

Refrigerant enters the first and second cylinders 106, 110 during a suction stroke of each piston 50, 54 when the piston 50, 54 is moving from a top dead center (TDC) position to a bottom dead center (BDC) position. When the piston 50, 54 is at the TDC position, the crankshaft 66 must rotate approximately one-hundred and eighty degrees (180°) to move the particular piston 50, 54 into the BDC position, thereby causing the piston 50, 54 to move from a location proximate to a top portion of the particular cylinder 106, 110 to a bottom portion of the cylinder 106, 110. While the pistons 50, 54 are moved to the BDC position from the TDC position, the particular cylinder 106, 110 is placed under a vacuum or vacuum-effect (hereinafter referred to as "vacuum" for simplicity), which causes suction-pressure vapor to be drawn into the cylinder 106, 110.

The first and second pistons 50, 54 move linearly in alternating directions as the crankshaft 66 is driven by an electric motor (not shown). As the crankshaft 66 rotates, the piston 50, 54 is driven in an upward direction, compressing refrigerant disposed within the cylinder 106, 110. When the pistons 50, 54 travel to the TDC position, the effective volume of the cylinder 106, 110 is reduced, thereby compressing the refrigerant disposed within the cylinder 106, 110. The compressed refrigerant remains in the gaseous state but is elevated from suction pressure to discharge pressure. At this point, the refrigerant may exit the cylinders 106, 110 and enter a discharge chamber 122.

Following compression, the piston 50, 54 returns to BDC and refrigerant is once again drawn into the cylinder 106, 110. While the first and second pistons 50, 54 are concurrently driven by the crankshaft 66, the first and second pistons 50, 54 are out-of-phase with one another. Namely, when one of the pistons 50, 54 is in the TDC position, the other of the pistons 50, 54 is in the BDC position. Further, when one of the pistons 50, 54 is moving from the BDC position to the TDC position, the other of the pistons 50, 54 is moving from the TDC position to the BDC position. Accordingly, for a compressor assembly 10 having a pair of pistons 50, 54, one of the pistons 50, 54 is drawing gaseous refrigerant into one of the cylinders 106, 110 during operation of the compressor assembly 10 while the other of the pistons 50, 54 is compressing refrigerant in the other of the cylinders 106, 110.

The refrigerant may be expelled from the cylinder head 18 through a discharge port 130 in the cylinder head 18 once the refrigerant reaches discharge pressure. The discharge-pressure refrigerant remains in the vapor state and may be communicated to a heat exchanger of an external refrigeration system (neither shown). For example, the discharge-pressure refrigerant may be communicated to a condenser (not shown) of a refrigeration system to allow the refrigerant to release heat and change phase from a vapor to a liquid, thereby providing a heating or cooling effect to a conditioned space.

With particular reference to FIGS. 1-4, a fluid-injection system such as an economized vapor-injection system 132 is shown as being implemented in the compressor assembly 10 to increase compressor performance. The vapor-injection system 132 may selectively inject intermediate-pressure vapor/gas into the compressor assembly 10 to improve system efficiency by providing additional system output or capacity through additional subcooling of the refrigerant in the system economizer shown in FIG. 27. Compressor power increase with injection vapor/gas is relatively less than the additional system capacity such that the overall system efficiency is increased. As all the vapor-injection systems will be described below, these injection systems could be used for liquid refrigerant injection or other fluid injection.

The vapor-injection system 132 may receive intermediate-pressure vapor from an external heat exchanger such as a flash tank or economizer heat exchanger (neither shown) and may selectively supply the intermediate-pressure vapor to the compressor housing 14 via the cylinder head 18 and the inlet port 26 formed in the top plate 22. The intermediate-pressure vapor may be stored in the vapor-storage plenum 34 until the intermediate-pressure vapor is needed during the compression cycle. Optionally, the vapor-storage plenum 34 may include an insulating layer 35 such as a polymeric or other insulating coating. The insulating layer 35 restricts heat associated with the discharge-pressure vapor from reaching the vapor-storage plenum 34.

The cylinder head 18 and the compressor housing 14 may cooperate to provide a fluid path extending between the vapor-storage plenum 34 and the cylinders 106, 110. The fluid path may include a pair of ports 133, 135 that are formed in the cylinder head 18 and are in communication with fluid passageways 134, 138 formed through the cylinder head 18. The passageways 134, 138 may extend through the cylinder head 18 such that each port 133, 135 is in fluid communication with ports 137, 139 formed in the valve plate 38 (FIG. 4) via the passageways 134, 138.

As shown in the FIG. 4, the ports 137, 139 are disposed in close proximity to the compressor housing 14 to allow intermediate-pressure vapor disposed within each passageway 134, 138 to freely flow from the passageways 134, 138 and into the compressor housing 14 via the ports 137, 139. The intermediate-pressure vapor flows into the ports 137, 139 due to the pressure difference between the pressure of the compressor housing 14 (at suction pressure) and the pressure of the intermediate-pressure vapor.

The intermediate-pressure vapor is permitted to freely enter a pair of fluid passageways 141, 143 (FIG. 4) formed in the compressor housing 14 but is restricted from freely flowing into the cylinders 106, 110 by the pistons 82, 86. Accordingly, the pistons 82, 86 control the flow of intermediate-pressure vapor from the passageways 134, 138 and into the first and second cylinders 106, 110.

In operation, the crankshaft 66 rotates the cam profile 70, as the cam profile 70 is fixed for rotation with the crankshaft 66. The cam profile 70 is shaped such that as the cam profile 70 rotates, the first and second followers 74, 78 move linearly, alternating in direction. The first and second followers 74, 78 and the first and second pistons 82, 86 are offset to utilize a single cam profile 70 to operate the opening and closing of both pistons 82, 86. The first and second springs 90, 94 are separated from the first and second followers 74, 78 by respective washers 142, 146 and keep constant contact between the first and second followers 74, 78 and the cam profile 70 by biasing the followers 74, 78 into engagement with the cam profile 70.

The first and second pistons 82, 86 may each include a substantially cylindrical shape with each piston 82, 86 being substantially hollow from a first end proximate to ports 137, 139 to a second end proximate to the first and second followers 74, 78. While the pistons 82, 86 are described as being substantially hollow, the followers 74, 78 may be received within respective second ends of the pistons 82, 86 to partially close each piston 82, 86 at the second end (FIG. 4).

In one configuration, the pistons 82, 86 are disposed within the passageways 141, 143 and are permitted to translate within each passageway 141, 143. Movement of the pistons 82, 86 relative to and within the passageways 141, 143 is accomplished by movement of the first and second followers 74, 78 relative to the compressor housing 14. Specifically, engagement between the first and second followers 74, 78 and the cam profile 70—due to the force exerted on each follower 74, 78 by the biasing members 90, 94—causes the followers 74, 78 to move relative to and within each passageway 141, 143 as the crankshaft 66 rotates.

While the biasing member 90, 94 urge each follower 74, 78 into engagement with the cam profile 70, the followers 74, 78 may also be biased into engagement with the cam profile 70 by the intermediate-pressure vapor disposed within the vapor-storage plenum 34. Specifically, intermediate-pressure vapor may be received within each piston 82, 86 from the vapor-storage plenum 34 at the first end of each piston 82, 86 and may exert a force directly on the followers 74, 78. Specifically, the intermediate-pressure vapor is permitted to flow into the substantially hollow portion of each piston 82, 86 due to the pressure differential between the vapor-storage plenum 34 (intermediate pressure) and the compressor housing 14 (suction pressure). Once the intermediate-pressure vapor enters and substantially fills each piston 82, 86, the intermediate-pressure vapor encounters each follower 74, 78 proximate to the second end of each piston 82, 86 and urges each follower 74, 78 toward the cam profile 70.

Permitting intermediate-pressure vapor to substantially fill each piston 82, 86 likewise allows any lubricant disposed within the intermediate-pressure vapor to likewise enter the pistons 82, 86. Such lubricant may be drained from the pistons 82, 86 via passageways 83, 87 (FIGS. 5 and 6) respectively formed in the followers 74, 78. Draining lubricant from the pistons 82, 86 prevents each piston 82, 86 from being filled with lubricant and further provides the added benefit of providing lubricant to point-of-contact between each follower 74, 78 and the cam profile 70.

As best shown in FIG. 4, the cam profile 70 includes an irregular shape that causes the rise and fall of the followers 74, 78 and, thus, the pistons 82, 86 within the passageways 141, 143. Because the cam profile 70 includes an irregular shape, the pistons 82, 86 will either move closer to or farther away from the valve plate 38 depending on the location of the followers 74, 78 along the cam profile 70.

Figure 6:
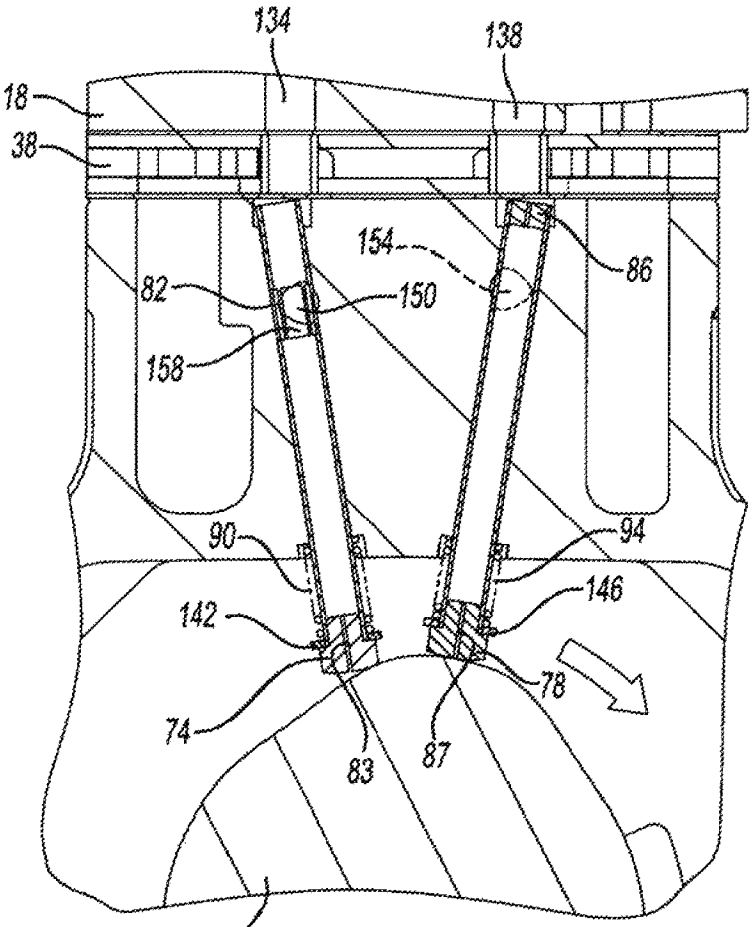
FIG. 6 is a partial cross-sectional view of the compressor of FIG. taken along line 4-4 and showing one of a pair of fluid-injection ports in an open state.
Figure 5:
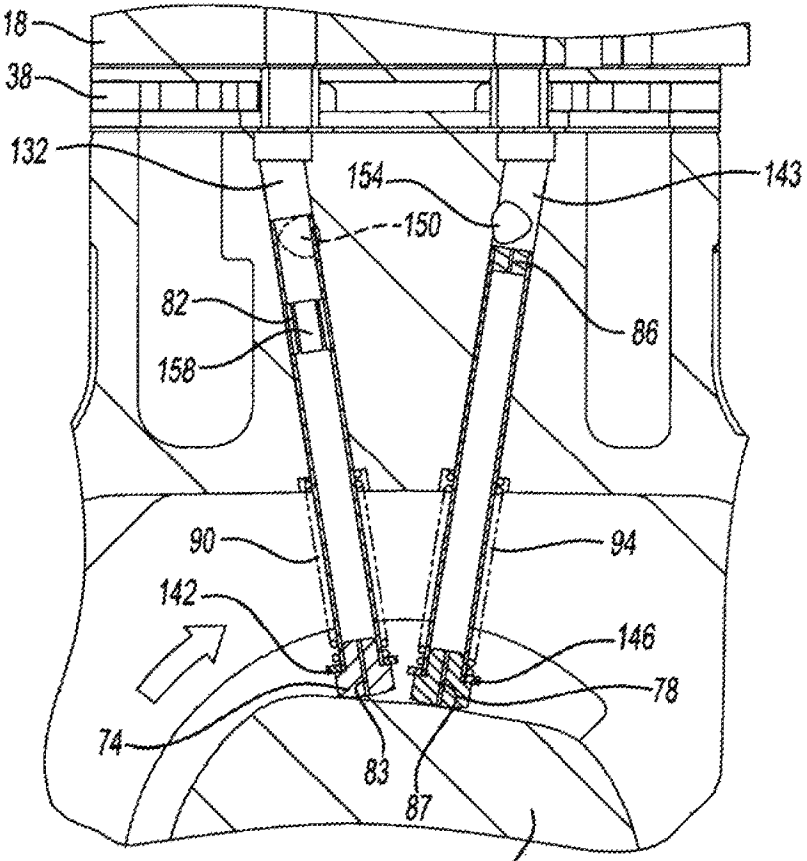
FIG. 5 is a partial cross-sectional view of the compressor of FIG. 1 taken along line 4-4 and showing one of a pair of fluid-injection ports in an open state.
Figure 7:
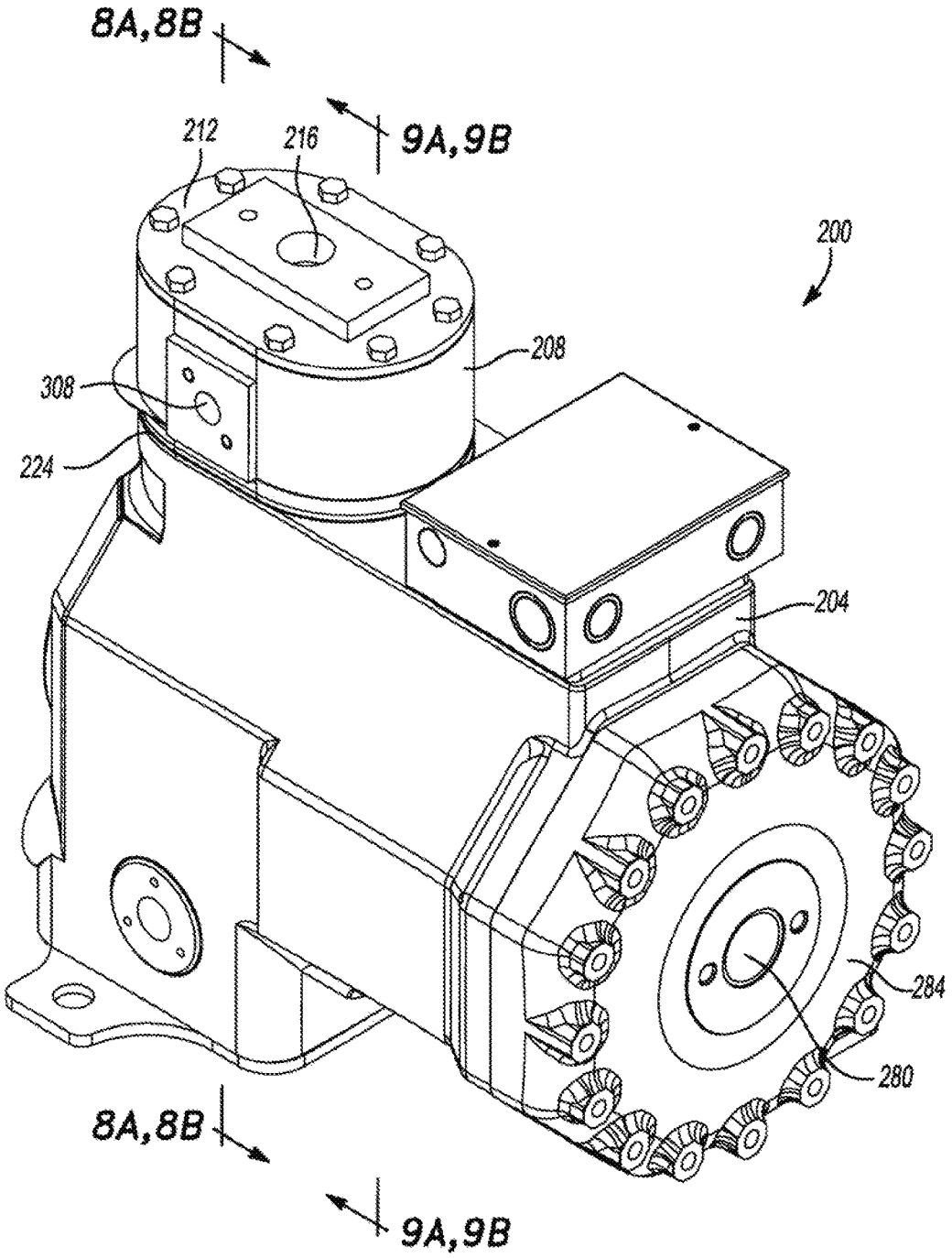
FIG. 7 is a perspective view of a compressor in accordance with the principles of the present disclosure.
Figure 8B:
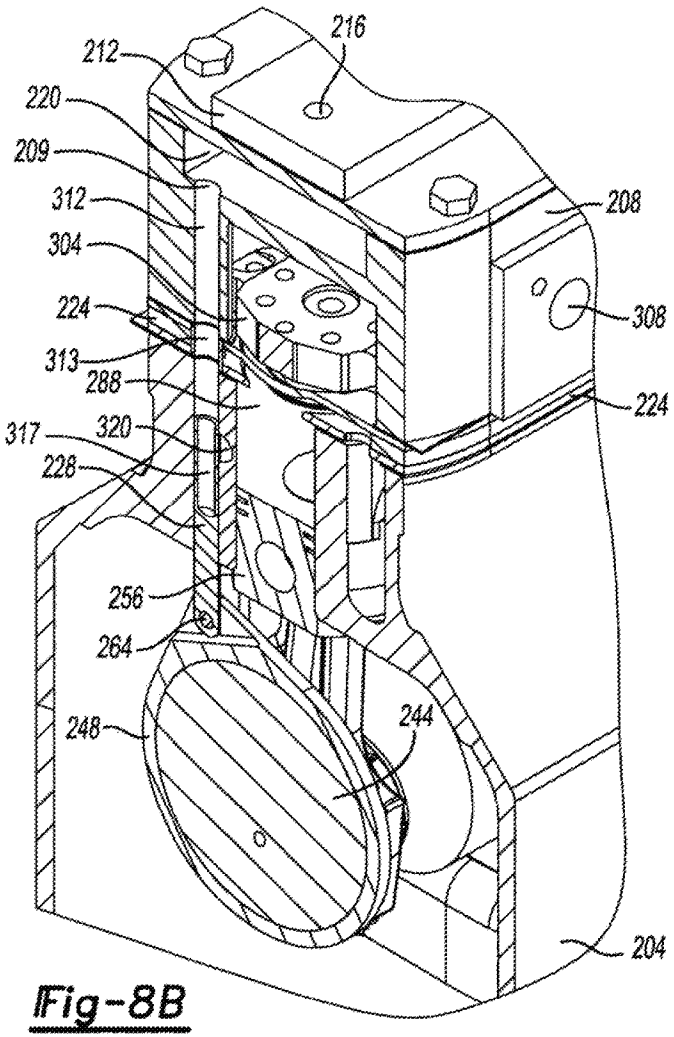
FIG. 8B is a perspective, cross-sectional view of the compressor of FIG. 7 taken along line 8B-8B and showing one of a pair of fluid-injection ports in a closed state.
Figure 8A:
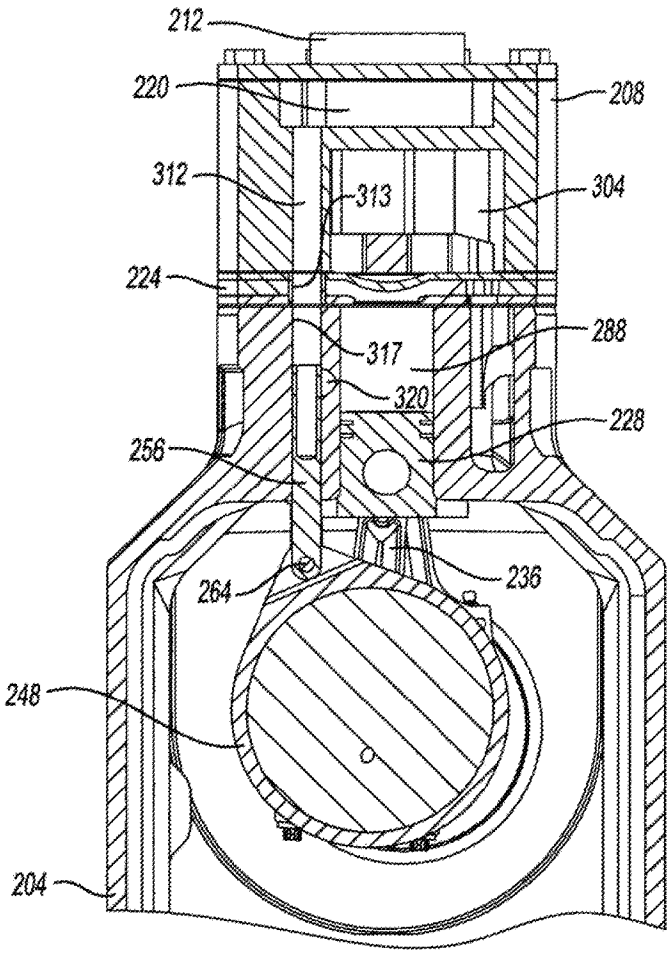
FIG. 8A is cross-sectional view of the compressor of FIG. 7 taken along line 8A-8A and showing one of a pair of fluid-injection ports in a closed state.
Figure 9B:
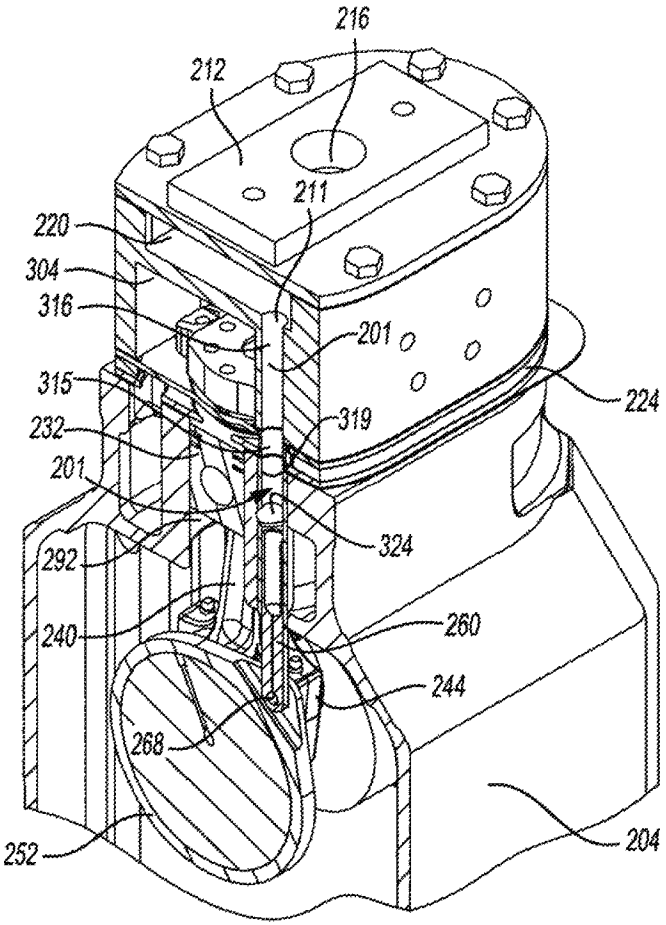
FIG. 9B is a perspective, cross-sectional view of the compressor of FIG. 7 taken along line 9B-9B and showing one of a pair of fluid-injection ports in an open state.
Figure 9A:
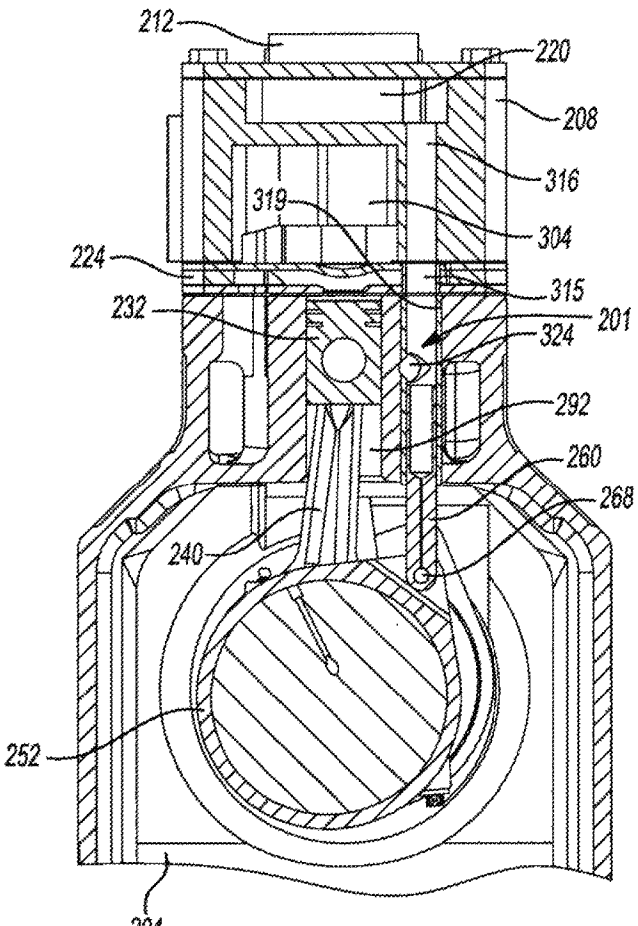
FIG. 9A is cross-sectional view of the compressor of FIG. 7 taken along line 9A-9A and showing one of a pair of fluid-injection ports in an open state.
Figure 10:
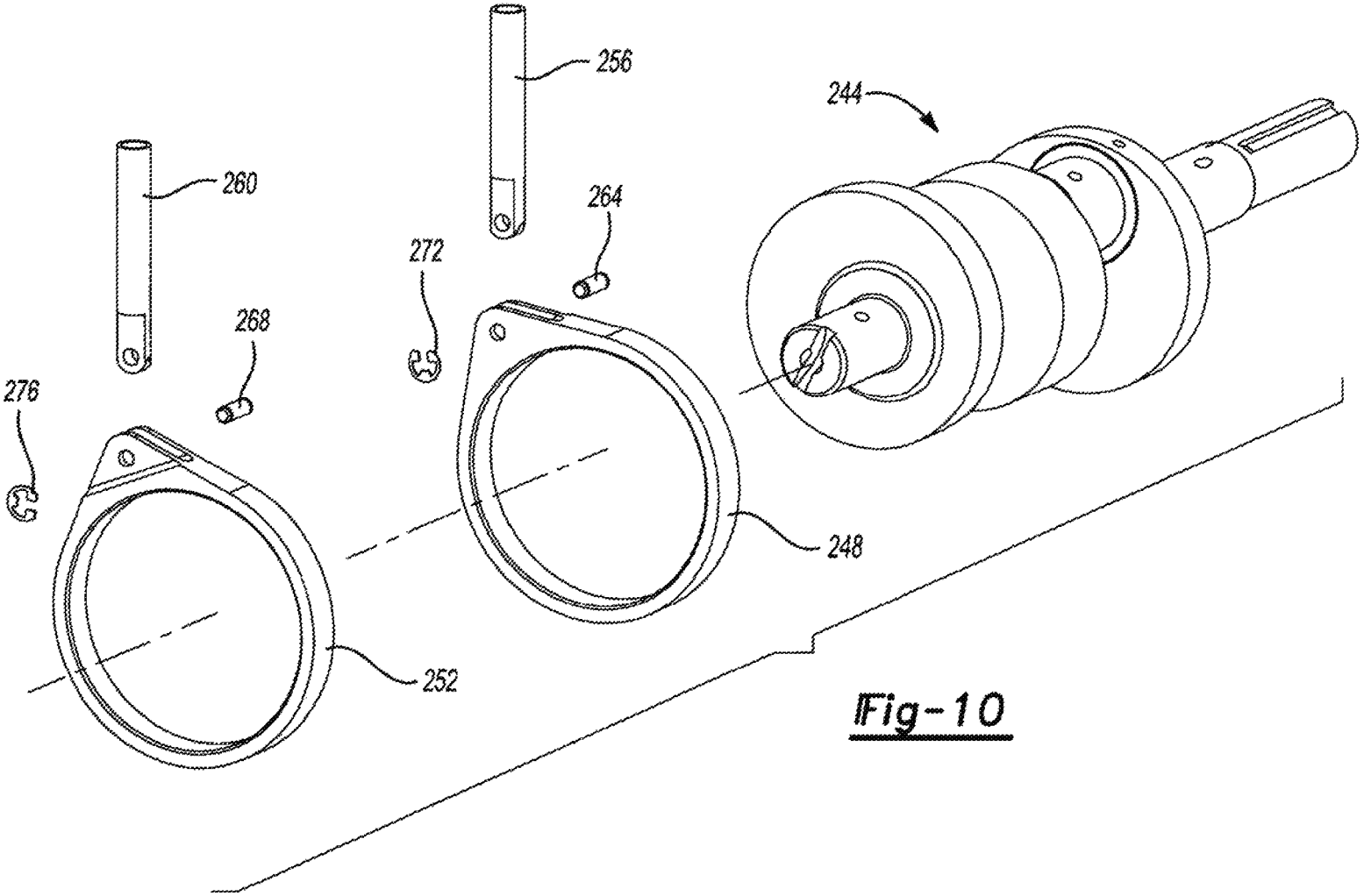
FIG. 10 is an exploded view of a crankshaft of the compressor of FIG. 7.
Figure 11:
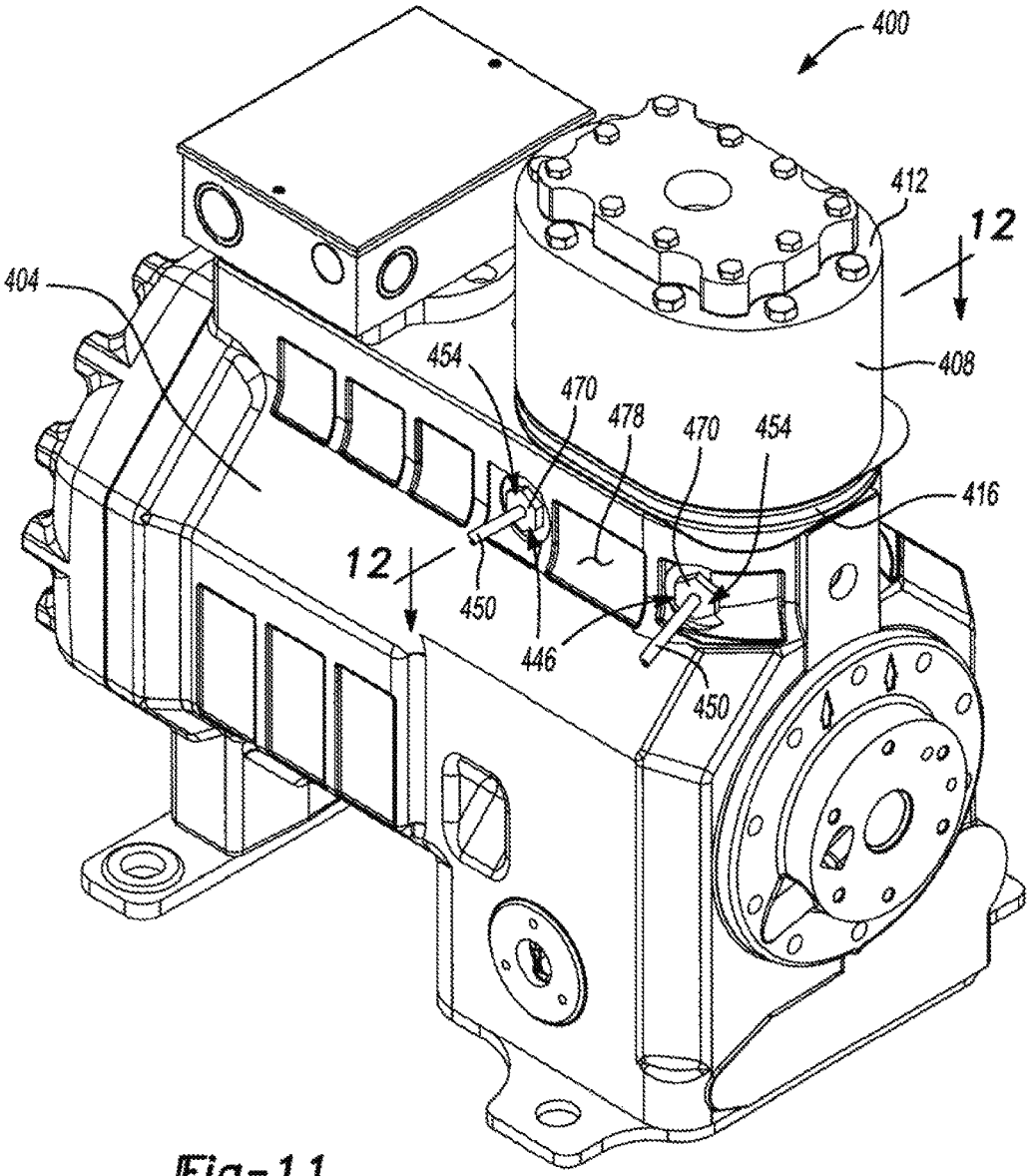
FIG. 11 is a perspective view of a compressor in accordance with the principles of the present disclosure.

With additional reference to FIGS. 5-6, the passageways 141, 143 may each include gas-inlet ports 150, 154 that are in communication with the cylinders 106, 110. The inlet ports 150, 154 allow intermediate-pressure vapor disposed within the passageways 141, 143 to flow into the cylinders 106, 110 to increase the pressure within the cylinders 106, 110, thereby reducing the work required to raise the pressure of the vapor within the cylinder 106, 110 to discharge pressure.

The flow of intermediate-pressure vapor from the passageways 141, 143 to the cylinders 106, 110 may be controlled by the pistons 82, 86. Specifically, one or both of the pistons 82, 86 may include a window 158 disposed along a length thereof. The window 158 may be positioned relative to one of the gas-inlet ports 150, 154 to allow the intermediate-pressure vapor to enter one of the first and second cylinders 106, 110. Additionally, one of the ports 150, 154 may be positioned at a location along one of the passageways 141, 143 such that the particular port 150, 154 is disposed in close proximity to the valve plate 38. If the port 150, 154 is positioned in close proximity to the valve plate 38, the piston 82, 86 disposed within the passageway 141, 143 may not need a window 158 to allow selective communication between the port 150, 154 and one of the cylinders 106, 110.

For example, if the port 154 is formed in close proximity to the valve plate 38, the piston 86 can close the port 150 when the first end of the piston 86 is in close proximity to the valve plate 38 (FIG. 6) and can open the port 154 when the first end of the piston 86 is moved sufficiently away from the valve plate 38 such that the piston 86 no longer blocks the port 154 (FIG. 5). Movement of the piston 86 is controlled by the location of the follower 78 along the cam profile 70. Accordingly, the cam profile 70 may be configured to allow the port 154 to open at a predetermined time relative to a position of the piston 54 within the cylinder 110. For example, the cam profile 70 may be shaped such that the piston 86 allows flow of intermediate-pressure vapor into the cylinder 110 for approximately the first ninety degrees (90°) of the compression process (i.e., for approximately the first half of the time the piston 54 moves from the BDC position to the TDC position). For the remainder of the compression process and the entire suction stroke (i.e., when the piston 54 moves from the TDC position to the BDC position), the piston 86 blocks the inlet port 154, thereby restricting flow of intermediate-pressure vapor from the vapor storage plenum 34 to the cylinder 110.

In other examples, the piston 86 may open the port 154 anytime between fifty degrees (50°) before the piston 54 reaches BDC (during a suction stroke) and fifty degrees (50°) after the piston 54 reaches BDC (during a compression stroke). Meanwhile the piston 86 may close the port 154 anytime between fifty degrees (50°) after the piston 54 reaches BDC (during the compression stroke) and one hundred twenty degrees (120°) after the piston 54 reaches BDC. For various refrigerants, the opening and closing of the port 154 may be optimized. For example, R404A may prefer to open at around twenty degrees (20°) before the piston 54 reaches BDC and close at around ninety degrees (90°) after the piston 54 reaches BDC.

The first piston 82 may operate in a similar fashion. However, the first piston 82 may be configured to permit flow of intermediate-pressure vapor from the vapor-storage plenum 34 to the cylinder 106 via the window 158 when the window 158 is placed in fluid communication with the port 150 (FIG. 6) and may prevent such communication when the window 158 does not oppose the port 150 (FIG. 5). As with the piston 86, the relative position of the piston 82 within the passageway 131 is controlled by the position of the follower 74 along the cam profile 70. Accordingly, the cam profile 70 may be shaped such that the piston 82 allows flow of intermediate-pressure vapor into the cylinder 106 for approximately the first ninety degrees (90°) of the compression process (i.e., for approximately the first half of the time the piston 50 moves from the BDC position to the TDC position). For the remainder of the compression process and the entire suction stroke (i.e., when the piston 50 moves from the TDC position to the BDC position), the first piston 82 blocks the inlet port 150, thereby restricting flow of intermediate-pressure vapor from the vapor storage plenum 34 to the cylinder 106.

While the piston 86 is described and shown as including a substantially uniform cross-section along a length thereof and the piston 82 is shown as including a window 158, either or both piston 82, 86 could be configured to have a uniform cross-section or a window 158. The configuration of the pistons 82, 86 and the location of the window 158 along the length of either or both pistons 82, 84 may be driven by the location of each port 150, 154 along the respective passageways 131, 143 as well as by the shape of the cam profile 70. Namely, each piston 82, 86 may include a substantially constant cross-section along a length thereof if the ports 150, 154 are positioned in sufficient proximity to the valve plate 38 and the shape of the cam profile 70 is such that the first ends of each piston 82, 86 may be sufficiently moved away from the ports 150, 154 (i.e., in a direction away from the valve plate 38) to selectively permit fluid communication between the passageways 134, 138 and the ports 150, 154 at a desired time relative to the compression cycle of each piston 50, 54.

While the vapor injection system 20 is described and shown as including a single cam profile 70, the crankshaft 66 could alternatively include separate cam profiles that separately control the pistons 82, 86. Such a configuration would allow the pistons 82, 86 to be substantially similar while concurrently opening and closing the respective ports 150, 154 at different times to accommodate the compression cycles of the respective pistons 50, 54.

With particular reference to FIGS. 7-10, a compressor assembly 200 is provided and may include a compressor housing 204 having a cylinder head 208. The cylinder head 208 may include a top plate 212 having an inlet port 216 and a vapor-storage plenum 220. The cylinder head 208 may be incorporated into the compressor body by a valve plate 224.

First and second pistons 228, 232 may be located within the compressor housing 204 and may be reciprocally movable in linear directions by respective connecting rods 236, 240. The connecting rods 236, 240 are disposed between the respective pistons 228, 232 and a crankshaft 244. While the compressor assembly 200 will be described and shown hereinafter as including two pistons 228, 232, the compressor assembly 200 may include fewer or more pistons.

The crankshaft 244 may include a first and second eccentric profile 248, 252 for controlling first and second rods 256, 260. The first and second rods 256, 260 may be driven by the crankshaft 244 and may be rotatably connected to first and second pistons 256, 260. The first and second rods 256, 260 may each include a pin 264, 268 and clamp 272, 276 (FIG. 10) that cooperate to attach the respective rods 256, 260 to one of the eccentric profiles 248, 252. Attachment of each rod 256, 260 to the respective eccentric profiles 248, 252 allows the rotational force of the crankshaft 244 to be imparted on each rod 256, 260, thereby allowing each rod 256, 260 to translate relative to and within the compressor housing 204.

In operation, refrigerant is compressed in the reciprocating compressor assembly 200 from a suction pressure to a desired discharge pressure. Suction-pressure refrigerant initially passes through a suction-inlet port 280 of an end cap 284 of the compressor housing 204. The refrigerant is drawn into the compressor housing 204 at the inlet port 280 due to the reciprocating motion of each piston 228, 232 within and relative to each cylinder 288, 292. As with the compressor assembly 10, the compressor assembly 200 is a so-called "low-side" compressor assembly, as the compressor housing 204 is at suction pressure. Accordingly, operation of the pistons 228, 232 draws suction-pressure vapor from the compressor housing 204 and into each cylinder 288, 292 which, in turn, cause more suction-pressure vapor to be drawn into the compressor housing 204. Once the refrigerant is disposed within each cylinder 288, 292, the first and second pistons 228, 232 cooperate with the crankshaft 244 to compress the refrigerant from suction pressure to discharge pressure in a similar fashion as described above with respect to the compressor assembly 10.

Namely, refrigerant enters the first and second cylinders 288, 292 during a suction stroke of each piston 228, 232 when the piston 228, 232 is moving from a top dead center (TDC) position to a bottom dead center (BDC) position. When the piston 228, 232 is at the TDC position, the crankshaft 244 must rotate approximately one-hundred and eighty degrees (180°) to move the particular piston 228, 232 into the BDC position, thereby causing the piston 228, 232 to move from a location proximate to a top portion of the particular cylinder 288, 292 to a bottom portion of the cylinder 288, 292. When the pistons 228, 232 are moved into the BDC position from the TDC position, the particular cylinder 288, 292 is placed under a vacuum, which causes suction-pressure vapor to be drawn into the cylinder 288, 292.

The first and second pistons 228, 232 move linearly in alternating directions as the crankshaft 244 is driven by an electric motor (not shown). As the crankshaft 244 rotates, the piston 228, 232 is driven in an upward direction, compressing refrigerant disposed within the cylinder 288, 292. When the pistons 228, 232 travel to the TDC position, the effective volume of the cylinder 288, 292 is reduced, thereby compressing the refrigerant disposed within the cylinder 288, 292. The compressed refrigerant remains in the gaseous state but is elevated from suction pressure to discharge pressure.

Following compression, the piston 228, 232 returns to BDC and refrigerant is once again drawn into the cylinder 288, 292. While the first and second pistons 228, 232 are concurrently driven by the crankshaft 244, the first and second pistons 228, 232 are out-of-phase with one another. Namely, when one of the pistons 228, 232 is in the TDC position, the other of the pistons 228, 232 is in the BDC position. Further, when one of the pistons 228, 232 is moving from the BDC position to the TDC position, the other of the pistons 228, 232 is moving from the TDC position to the BDC position. Accordingly, for a compressor assembly 200 having a pair of pistons 228, 232, one of the pistons 228, 232 is drawing gaseous refrigerant into one of the cylinders 288, 292 during operation of the compressor assembly 200 while the other of the pistons 228, 232 is compressing refrigerant in the other of the cylinders 288, 292.

The refrigerant may be expelled from the housing 204 through the discharge port 308 in the compressor housing 204 once the refrigerant reaches discharge pressure. The discharge-pressure refrigerant remains in the vapor state and may be communicated to a heat exchanger of an external refrigeration system (neither shown). For example, the discharge-pressure refrigerant may be communicated to a condenser (not shown) of a refrigeration system to allow the refrigerant to release heat and change phase from a vapor to a liquid, thereby providing a heating or cooling effect to a conditioned space.

With continued reference to FIGS. 7-10, the compressor assembly 200 is shown as including an economized vapor-injection system 201 that improves compressor performance and efficiency. The vapor injection system 201 may selectively inject intermediate-pressure vapor into the compressor assembly 200 to improve system efficiency by providing extra output or capacity of the compressor and gaining system capacity through extra subcooling of the refrigerant in the system economizer shown in FIG. 27.

The vapor injection system 201 may receive intermediate-pressure vapor from an external heat exchanger such as a flash tank or economizer heat exchanger (neither shown) and may selectively supply the intermediate-pressure vapor to the compressor housing 204 via the cylinder head 208 and the inlet port 216 formed in the top plate 212. The intermediate-pressure vapor may be stored in the vapor-storage plenum 220 until the intermediate-pressure vapor is needed during the compression cycle.

The cylinder head 208 and the compressor housing 204 may cooperate to provide a fluid path extending between the vapor-storage plenum 220 and the cylinders 288, 292. The fluid path may include a pair of ports 209 (FIG. 8B), 211 (FIG. 9B) that are formed in the cylinder head 208 and are in communication with fluid passageways 312, 316 formed through the cylinder head 208. The passageways 312, 316 may extend through the cylinder head 208 such that each port 209, 211 is in fluid communication with ports 313 (FIG. 8A), 315 (FIG. 9A) formed in the valve plate 224 (FIGS. 8A-9B) via the passageways (312, 316).

As shown in the FIGS. 8A-9B, the ports 313, 315 are disposed in close proximity to the compressor housing 204 to allow intermediate-pressure vapor disposed within each passageway 312, 316 to freely flow from the passageways 312, 316 and into the compressor housing 204 via the ports 313, 315.

The intermediate-pressure vapor is permitted to freely enter a pair of fluid passageways 317, 319 formed in the compressor housing 204 but is restricted from freely flowing into the cylinders 288, 292 by the first and second rods 256, 260. Accordingly, the first and second rods 256, 260 control the flow of intermediate-pressure vapor from the passageways 317, 319 and into the first and second cylinders 288, 292.

With particular reference to FIGS. 8A-9B, operation of the vapor-injection system 201 will be described in detail. Rotation of the crankshaft 244 likewise causes rotation of the first and second eccentric profiles 248, 252 relative to the compressor housing 204. The first and second eccentric profiles 248, 252 are shaped such that as the first and second eccentric profiles 248, 252 rotate, the first and second rods 256, 260 move linearly, alternating in direction. As the first and second rods 256, 260 rise and fall in relation to the first and second eccentric profiles 248, 252, the first and second rods 256, 260 open and close first and second gas-inlet ports 320, 324 to allow the intermediate-pressure vapor to enter the first and second cylinders 288, 292. The first and second eccentric profiles 248, 252 are shaped to allow gas flow into each cylinder 288, 292 for a predetermined time during the compression stroke (i.e., approximately the first half of piston travel from BDC to TDC). For the remainder of the compression stroke and the entire suction stroke, the first and second rods 256, 260 block the first and second gas-inlet ports 320, 324 to prevent the flow of intermediate-pressure vapor into the cylinders 288, 292.

The first and second rods 256, 260 may be attached at specific locations around a perimeter of the first and second eccentric profiles 248, 252 to control injection of intermediate-pressure vapor into the first and second cylinders 288, 292. For example, the first rod 256 may expose the first gas-inlet port 320 to allow gas flow into the first cylinder 288 (FIGS. 8A-8B) for the first half of piston travel from BDC to TDC (i.e., the first ninety degrees (90°) of rotation of the crankshaft 244 during the compression cycle). After the predetermined amount of time during the compression cycle, the first rod 256 rises to block the port 320 for the remainder of the compression cycle to prevent intermediate-pressure vapor from entering the cylinder 288.

The second rod 260 may block the second gas-inlet port 324 when the first gas-inlet port 320 is open. Conversely, the second rod 260 may retract and open the second gas-inlet port 324 when the first gas-inlet port 320 is closed. In short, the first rod 256 and the second rod 260 are out-of-phase with one another and, as a result, do not permit both ports 320, 324 to be open at the same time.

The first rod 256 and the second rod 260 may cooperate with the first and second eccentric profiles 248, 252, respectively, to open the ports 320, 324 at different times to accommodate compression timing in each cylinder 288, 292. Namely, the first rod 256 and second rod 260 may be poisoned in a lowered state to respectively open the ports 320, 324 at different times such that the ports 320, 324 are open for the first half of piston travel from BDC to TDC (i.e., the first ninety degrees (90°) of rotation of the crankshaft 244 during the compression cycle) for each piston 228, 232.

With reference to FIGS. 11-15, a compressor assembly 400 is provided and may include a compressor housing 404 having a cylinder head 408. The cylinder head 408 may include a top plate 412 and may be incorporated into the compressor housing 404 by a valve plate 416.

First and second pistons may be located within the compressor housing 404 and may be reciprocally movable in linear directions by respective connecting rods 426, 430. The connecting rods 426, 430 are disposed between the respective pistons 418, 422 and a crankshaft (not shown). While the crankshaft is not shown, the crankshaft may be similar, if not identical, to the crankshaft 66 of the compressor assembly 10 described above (not including cam profile 70). While the compressor assembly 400 will be described and shown hereinafter as including two pistons 418, 422, the compressor assembly 400 may include fewer or more pistons.

In operation, refrigerant is compressed in the compressor assembly 400 from a suction pressure to a desired discharge pressure. Suction pressure refrigerant is received by the compressor housing 400 and is drawn into cylinders 438, 442, respectively associated with the pistons 418, 422. As with the compressor assemblies 10, 200, the compressor assembly 400 is a so-called "low-side" compressor assembly, as the compressor housing 404 is at suction pressure. Accordingly, operation of the pistons 418, 422 draws suction-pressure vapor from the compressor housing 404 into each cylinder 438, 442 which, in turn, causes more suction-pressure vapor to be drawn into the compressor housing 404. Once the refrigerant is disposed within each cylinder 438, 442, the pistons 418, 422 cooperate with the crankshaft to compress the refrigerant from suction pressure to discharge pressure in a similar fashion as described above with respect to the compressor assemblies 10, 200.

Refrigerant enters the cylinders 438, 442 during a suction stroke of each piston 418, 422 when the piston 418, 422 is moving from a top dead center (TDC) position to a bottom dead center (BDC) position. When the piston 418, 422 is at the TDC position, the crankshaft must rotate approximately one-hundred and eighty degrees (180°) to move the particular piston 418, 422 into the BDC position, thereby causing the piston 418, 422 to move from a location proximate to a top portion of the particular cylinder 438, 442 to a bottom portion of the cylinder 438, 442. When the pistons 418, 422 are moved into the BDC position from the TDC position, the particular cylinder 438, 442 is placed under a vacuum which causes suction-pressure vapor to be drawn into the cylinder 438, 442.

The pistons 418, 422 move linearly in alternating directions as the crankshaft is driven by an electric motor (not shown). As the crankshaft rotates, the piston 418, 422 is driven in an upward direction, compressing refrigerant disposed within the cylinder 438, 442. When the pistons 418, 422 travel to the TDC position, the effective volume of the cylinder 438, 442 is reduced, thereby compressing the refrigerant disposed within the cylinder 438, 442. The compressed refrigerant remains in the gaseous state but is elevated from suction pressure to discharge pressure.

Following compression, the piston 418, 422 returns to the BDC position and refrigerant is once again drawn into the cylinder 438, 442. While the pistons 418, 422 are concurrently driven by the crankshaft, the pistons 418, 422 are out-of-phase with one another. Namely, when one of the pistons 418, 422 is in the TDC position, the other of the pistons 418, 422 is in the BDC position. Further, when one of the pistons 418, 422 is moving from the BDC position to the TDC position, the other of the pistons 418, 422 is moving from the TDC position to the BDC position. Accordingly, during operation of the compressor assembly 400, one of the pistons 418, 422 is drawing gaseous refrigerant into one of the cylinders 438, 442 while the other of the pistons 418, 422 is compressing refrigerant in the other of the cylinders 438, 442. Once the refrigerant reaches discharge pressure, the refrigerant may be expelled from the compressor housing 404 in a similar fashion as described above with respect to the compressor assemblies 10, 200.

With particular reference to FIGS. 11-16, the compressor assembly 400 is shown as including a vapor-injection system 446 that improves compressor performance and efficiency. The vapor-injection system 446 may selectively inject intermediate-pressure vapor into the compressor assembly 400 to improve system efficiency by providing extra output or capacity of the compressor and gaining system capacity through extra subcooling of the refrigerant in the system economizer shown in FIG. 27.

The vapor-injection system 446 may receive intermediate-pressure vapor from an external heat exchanger such as a flash tank or economizer heat exchanger 800 (FIG. 27) and may selectively supply the intermediate-pressure vapor to the compressor housing 404 via a conduit 450. One or more conduits 454 may be coupled to the compressor assembly 400 at respective injection ports 454 to allow intermediate-pressure vapor to be directed into the cylinders 438, 442 by the injection ports 454.

The injection ports 454 may include an injector body 458 that is received within a bore 462 of the compressor housing 404. The injector body 458 may include a passageway 466 that extends along a length of the injector body 458 and is fluidly coupled to the conduit 450. In one configuration, the passageway 466 receives the conduit 450, whereby the conduit 450 extends along an entire length of the passageway 466. While the conduit 450 is described and shown as extending along an entire length of the passageway 466, the conduit 450 could alternatively extend only partially along the passageway 466 or may extend to an opening of the passageway 466 without extending into the injector body 458. Regardless of the position of the conduit 450 relative to the passageway 466, the conduit 450 is in fluid communication with the passageway 466 to supply the passageway 466 and, thus, the cylinders 438, 442 with intermediate-pressure vapor.

The injector body 458 may include a shoulder 470 that abuts the compressor housing 404 to properly position the injector body 458 relative to the compressor housing 404. One or more seals 474 (FIG. 12) may be disposed between the injector body 458 proximate to the shoulder 470 and/or along a length of the injector body 458 to prevent entry of debris into the cylinders 438, 442 between the injector body 458 and the bores 462 or to prevent any fluid leakage from bore 462.

Figure 12:
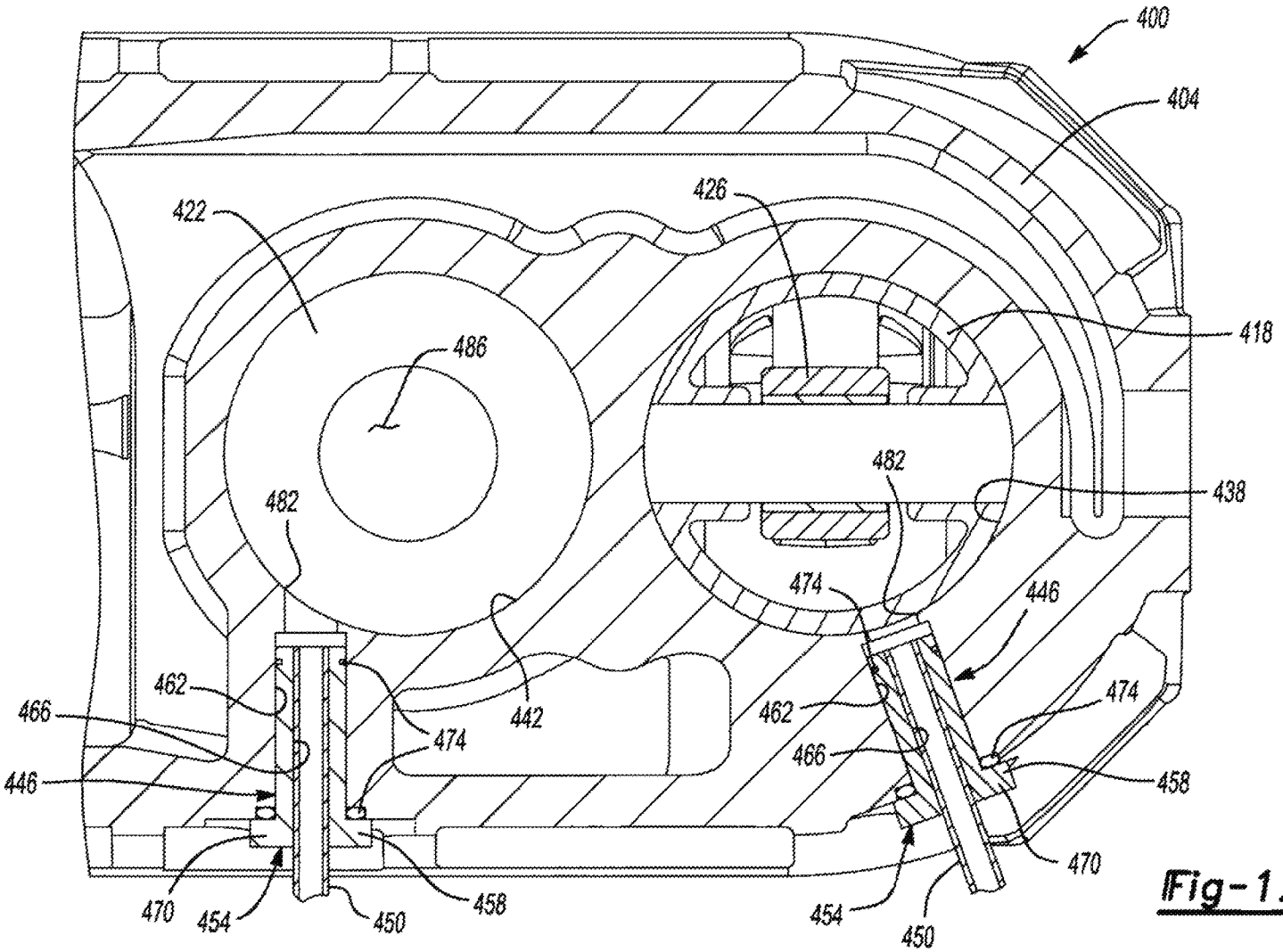
FIG. 12 is a cross-sectional view of the compressor of FIG. 11 taken along line 12-12.

The bores 462 extend into the respective cylinders 438, 442 and are in fluid communication with the respective cylinders 438, 442. As shown in FIG. 12, each bore 462 is formed through the compressor housing 404 to allow the bores 462 to extend between an external surface 478 (FIG. 11) and each cylinder 438, 442.

Figure 13:
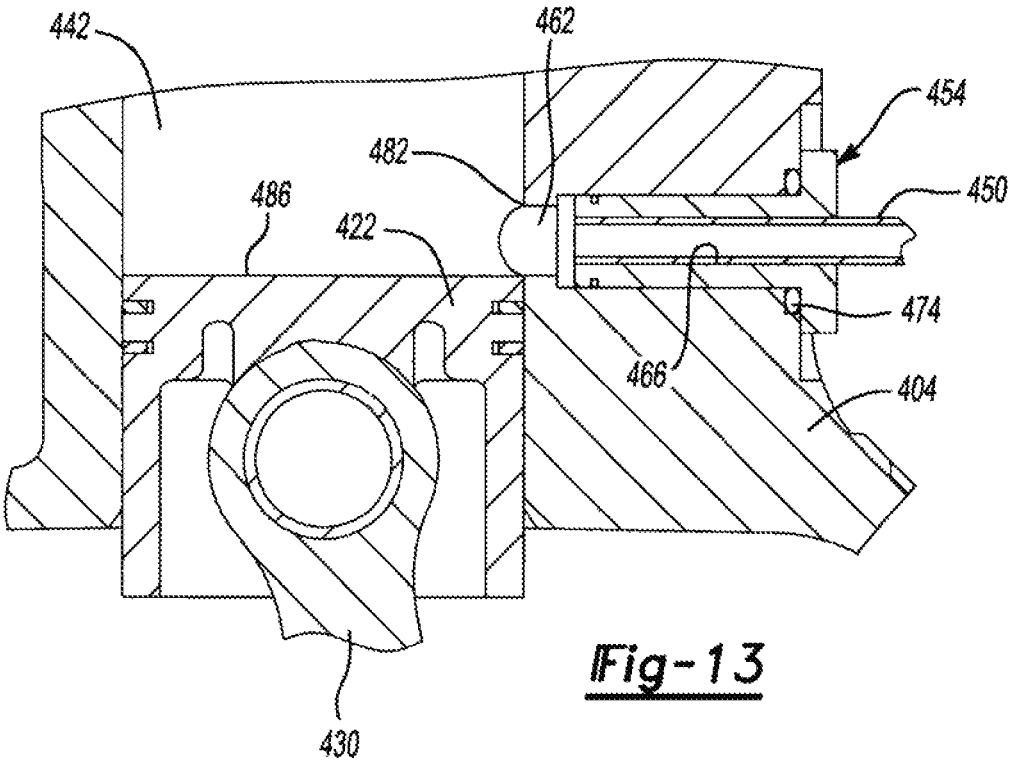
FIG. 13 is a schematic cross-sectional view of a compression cylinder of the compressor of FIG. 11.
Figure 14:
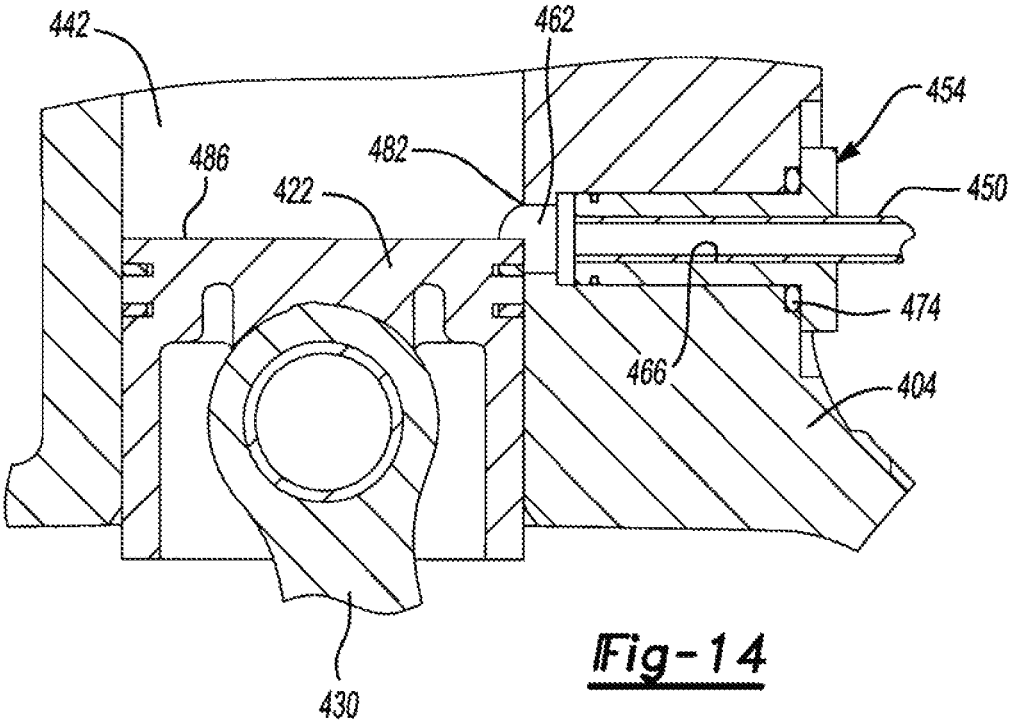
FIG. 14 is a schematic cross-sectional view of an alternate cylinder of the compressor of FIG. 11.

The bores 462 may be positioned along a length of each cylinder 438, 442 such that an outlet 482 of each bore 462 is aligned with a top surface 486 of each piston 418, 422 when each piston 418, 422 is in the BDC position within each cylinder 438, 442, as shown in FIG. 13. Alternatively, the outlet 482 may be positioned along a length of each cylinder 438, 442 such that the outlet 482 extends below the top surface 486 of each piston 418, 422 when each piston 418, 422 is in the BDC position (FIG. 14). In an alternative configuration, bore 462 may exclude the use of the injector body 458 and simply connect the conduit 450 to bore 462, thereby allowing fluid to flow through the conduit 450, the bore 462, the outlet 482, and into the cylinders 438, 442

Figure 15:
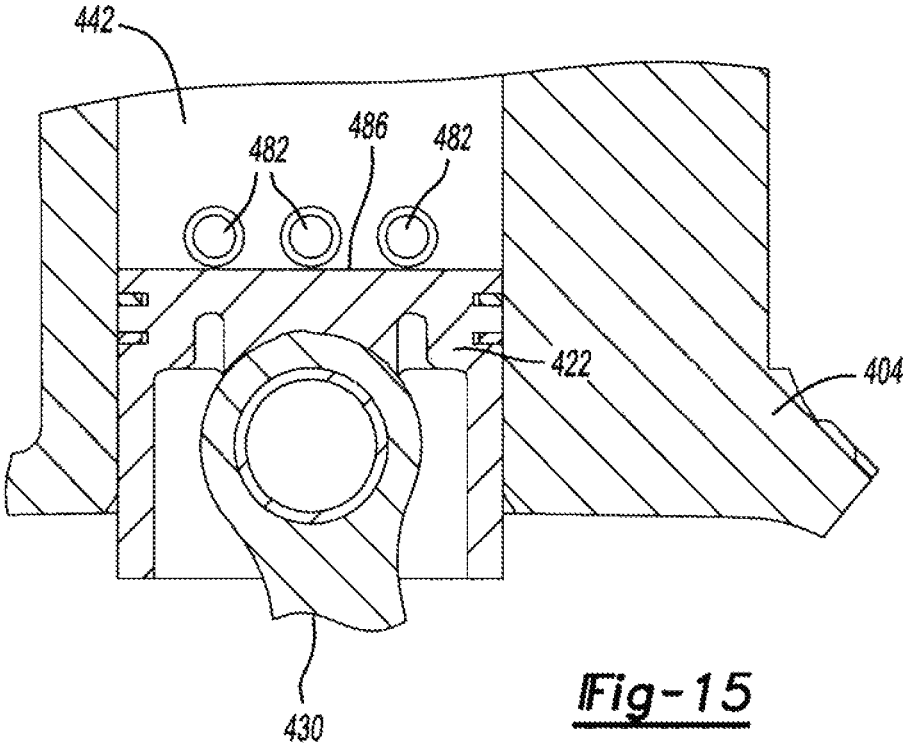
FIG. 15 is a schematic cross-sectional view of an alternate cylinder of the compressor of FIG. 11.

While the outlet 482 is shown as being a single outlet, multiple outlets 482 could be used in conjunction with one or more of the cylinders 438, 442. For example, three outlets 482 could be used in conjunction with one or both of the cylinders 438, 442, as shown in FIG. 15. The outlets 482 may be aligned with the top surface 486 of the pistons 418, 422 when the pistons 418, 422 are in the BDC position (FIG. 15) or, alternatively, may be disposed below the top surface 486 of the piston 418, 422 when the piston 418, 422 is in the BDC position. The use of more than one outlet 482 allows injection to occur closer to the piston 418, 422 being in the BDC position while allowing an equivalent flow area as a single large port, which may result in improved capacity and efficiency for the compressor assembly 400. The plurality of outlets 482 would therefore be smaller in size when compared to the outlets 482 shown in FIGS. 13 and 14.

The outlet or plurality of outlets 482 may include a dimension that is shorter in the direction of the piston 418, 422 travel within the cylinders 438, 442 when compared to a dimension of the outlet or plurality of outlets 482 that extends in a direction around each cylinder 438, 442. Such a configuration reduces the amount of time the injection port is exposed to the cylinder 438, 442, while still providing enough flow area. For example, outlet 482 could be a plurality of ovals or slots where the short axis would be aligned with the motion of piston 422, 426. It is also envisioned that the outlet 482 could be above the top surface 486 of piston 422, 426.

Regardless of the particular configuration of the outlet 482 of the bores 462, a valve assembly 490 may be used in conjunction with the conduit 450 to delay the flow of intermediate-pressure gas along and through the conduit 450. Delaying the flow of intermediate-pressure gas along the conduit 450 may be advantageous to properly time injection of intermediate-pressure gas into each cylinder 438, 442 with the pistons 418, 422 being in the BDC position.

Figure 16:
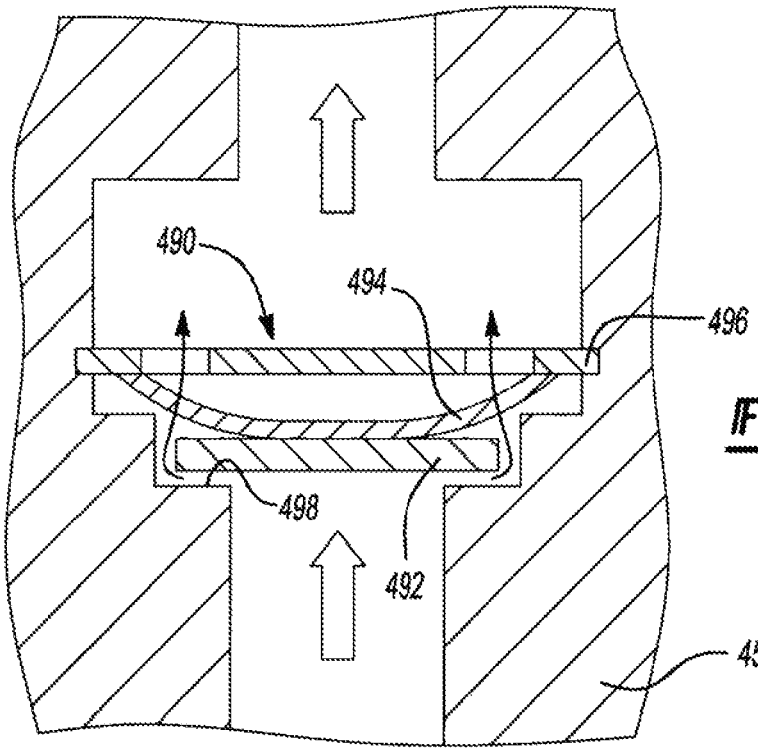
FIG. 16 is a schematic cross-sectional view of a vapor-injection conduit having a valve for use in conjunction with the compressor of FIG. 11.

The valve assembly 490 may include a valve element 492, a biasing element 494, and a retainer plate 496. The retainer plate 496 may be fixed relative to the conduit 450 and may position the biasing element 494 relative to the valve element 492. The valve element 492 may be moved between a closed state in contact with a valve seat 498 and an open state (FIG. 16). When the valve element 492 is in the open state, intermediate-pressure vapor is permitted to flow around the valve element 492 and through the injection port 454 to allow the intermediate-pressure vapor to be received within each cylinder 438, 442. The valve element 492 is biased into engagement with the valve seat 498 by the biasing element 494 and is movable from the closed state to the open state (FIG. 16) when a sufficient force is exerted on the valve element 492 to overcome the force exerted on the valve element 492 by the biasing element 494.

The force exerted on the valve element 492 is created due to operation of the pistons 418, 422 within each cylinder 438, 442. Specifically, as each piston 418, 422 draws suction-pressure gas into each cylinder 438, 442, a vacuum or pressure differential is likewise created within each conduit 450, thereby causing the valve element 492 to exert a force against the biasing element 494 and move into the open state. The valve element 492 therefore delays entry of intermediate-pressure gas into each cylinder 438, 442 until the piston 418, 422 is in a desired location within each cylinder 438, 442. Namely, the valve element 492 cooperates with the biasing element 494 to permit entry of intermediate-pressure gas into each cylinder 438, 442 when the pistons 418, 422 are in or are approaching the BDC position. Injecting intermediate-pressure vapor at this point during a compression cycle maximizes the benefits of having intermediate-pressure gas disposed within each cylinder 438, 442 and may also minimize backflow of fluid into the conduit 450.

With continued reference to FIGS. 11-16, operation of the vapor-injection system 446 will be described in detail. The pistons 418, 422 are moved between the TDC position and the BDC position due to rotation of the crankshaft relative to and within the compressor housing 404. When the pistons 418, 422 are in or are approaching the BDC position, vapor may be introduced into the cylinders 438, 442 by the vapor-injection system 446. For example, when the piston 418, 422 is in or is approaching the BDC position shown in FIGS. 13, 14, and 15, the piston 418, 422 exposes the outlet 482 of the bores 462, thereby permitting entry of intermediate-vapor into each cylinder 438, 442. When the pistons 418, 422 move sufficiently from the BDC position toward the TDC position, the pistons 418, 422 close the outlet 482 of the bores 462, thereby preventing entry of intermediate-pressure vapor into the cylinders 438, 442. If the pistons 418, 422 do not fully expose the outlet 482 of the bore 462 (FIG. 14) when the pistons 418, 422 are in the BDC position, the pistons 418, 422 expose a portion of the outlet 482 while simultaneously blocking a portion of the outlet 482. Such an arrangement serves to allow equivalent flow area as with a fully exposed larger port while properly timing the entry of intermediate-pressure gas into the cylinders 438, 442 with the pistons 418, 422 reaching the BDC position.

When the pistons 418, 422 block the outlet 482, vapor from the vapor-injection system 446 remains in the conduit 450 but is prevented from entering the cylinders 438, 442 due to the pistons 418, 422 blocking the outlet 482. In the configuration shown in FIG. 15, the outlets 482 are substantially aligned with one another such that the piston 418, 422 selectively opens and closes each outlet 482 substantially simultaneously. Accordingly, when the piston 418, 422 is sufficiently moved from the BDC position to the TDC position, each of the outlets 482 are sealed by the pistons 418, 422, thereby preventing injection of intermediate-pressure vapor into the cylinders 438, 442.

When the pistons 418, 422 are moved into the BDC position, the outlet 482 (FIGS. 13 and 14) or the outlets (FIG. 15) are exposed, thereby exposing the conduit 450 to a pressure differential caused by movement of the pistons 418, 422 relative to and within the respective cylinders 438, 442. The pressure differential exerted on the conduit 450 draws intermediate-pressure vapor into the cylinders 438, 442 to reduce the overall work required by the compressor assembly 400 in raising the pressure of the suction-pressure and injection gas to discharge pressure relative to the capacity gain provided by the additional refrigerant subcooling attained with the economizer 800. If the conduit 450 includes the valve assembly 490, the pressure differential must first overcome the force exerted on the valve element 492 by the biasing element 494 before intermediate-pressure gas is permitted to flow into the cylinders 438, 442 via the bores 462. Once the force is exerted on the conduit 450 due to the pressure differential created by the pistons 418, 422, the valve element 492 compresses the biasing element 494, thereby permitting intermediate-pressure vapor to flow around the valve element 492 and enter the cylinders 438, 442 via the outlet 482 of the bore 462. Additionally, the pressure of the intermediate-pressure vapor is higher than suction pressure and therefore this pressure difference will allow the intermediate-pressure vapor to enter into the cylinder 438, 442.

As described above, the pistons 418, 422 are driven by a crankshaft such that when one of the pistons 418, 422 is in the BDC position, the other of the pistons 418, 422 is in the TDC position. Accordingly, intermediate-pressure vapor is only injected into one of the cylinders 438, 442 at any given time, as only one of the pistons 418, 422 may be in the BDC position at any given time.

Figure 17:
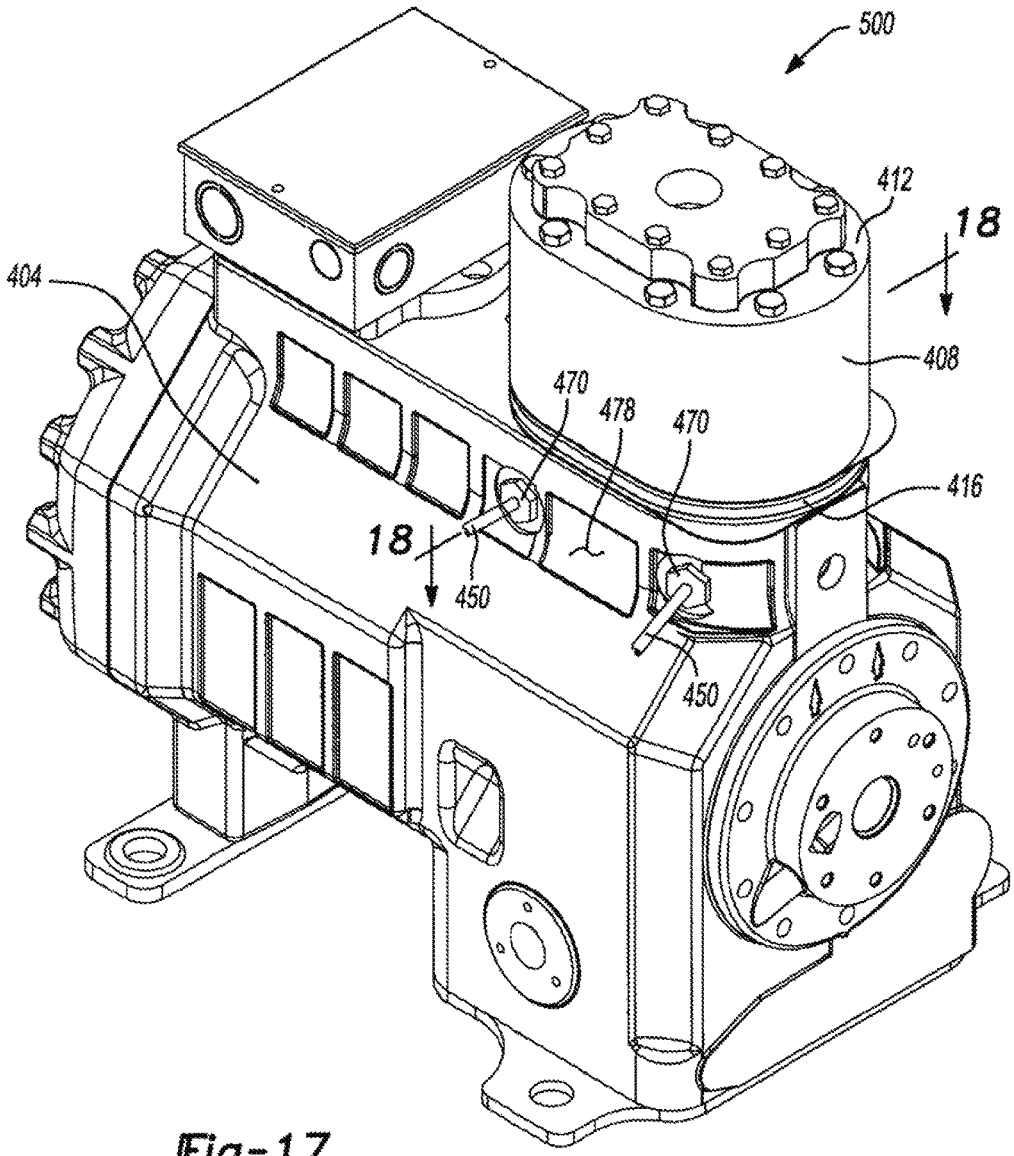
FIG. 17 is a perspective view of a compressor in accordance with the principles of the present disclosure.
Figure 18:
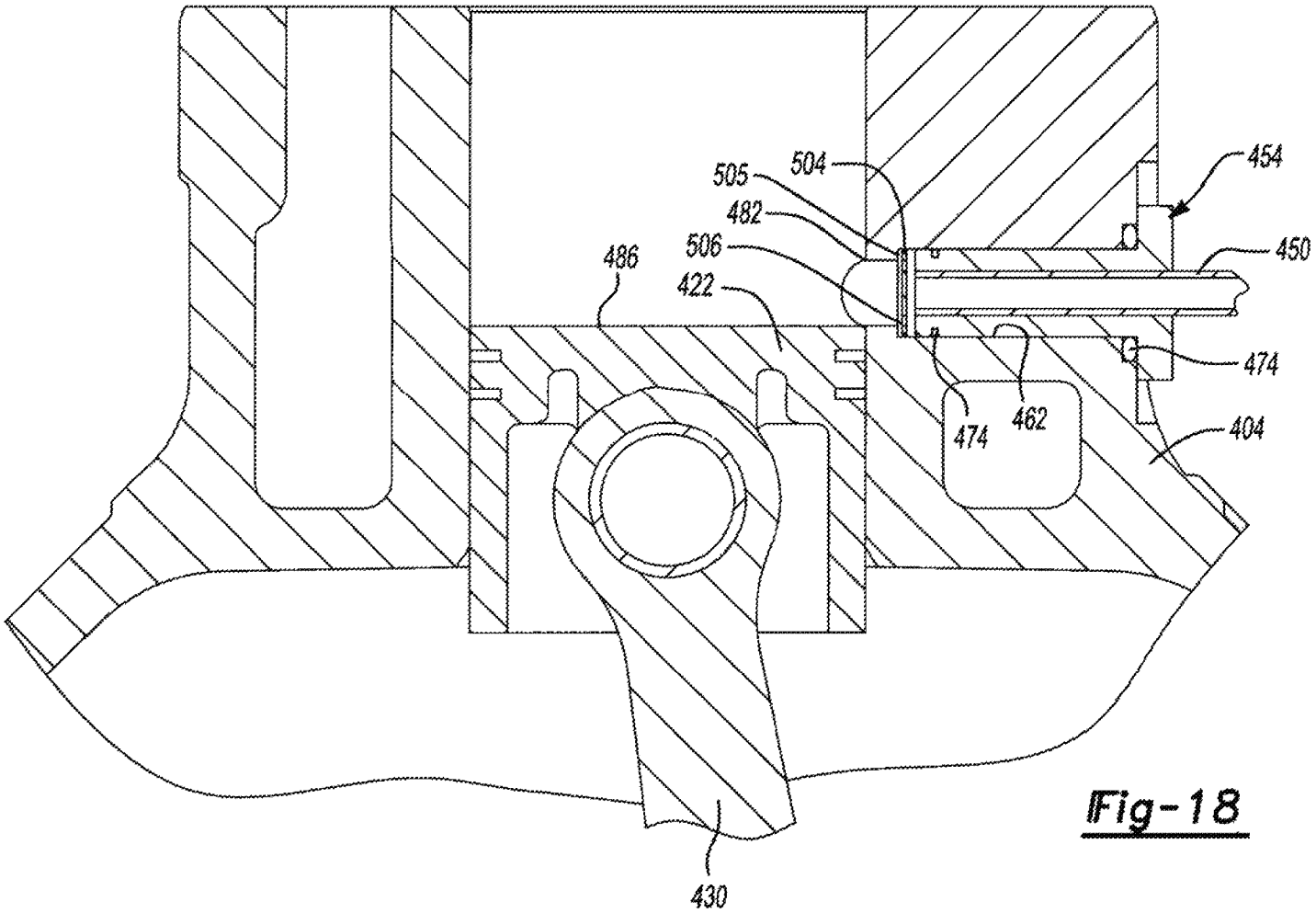
FIG. 18 is a cross-sectional view of the compressor of FIG. 17 taken along line 18-18.
Figure 19:
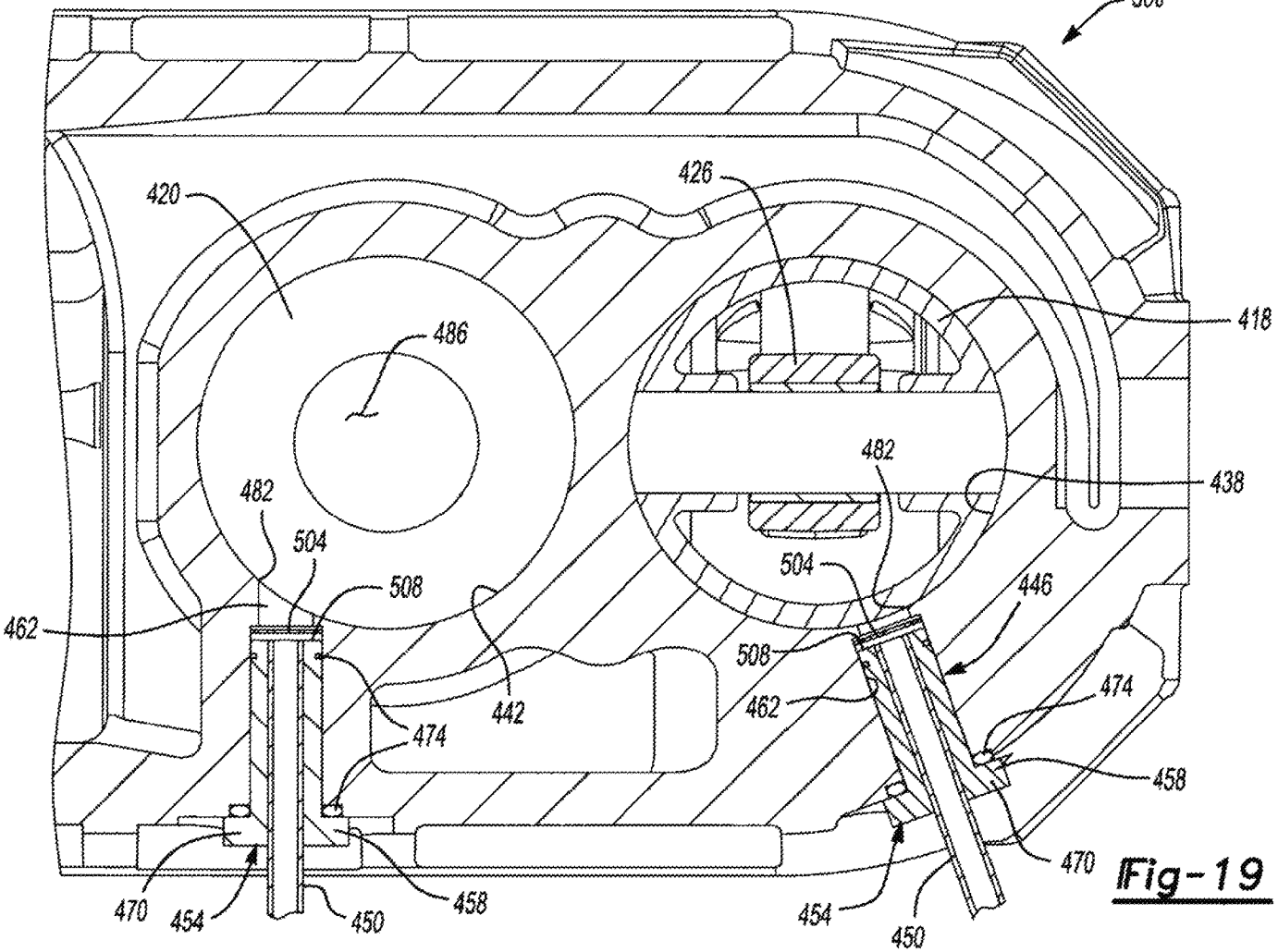
FIG. 19 is a partial cross-sectional view of the compressor of FIG. 17.

With particular reference to FIGS. 17-19, a compressor assembly 500 is provided. In view of the substantial similarity in structure and function of the components associated with the compressor assembly 400 with respect to the compressor assembly 500, like reference numerals are used hereinafter in the drawings to identify like components.

The compressor assembly 500 is substantially similar to the compressor assembly 400 with the exception of a valve element 504 used in conjunction with the vapor-injection system 446. Accordingly, description of the operation of the compressor assembly 500 is foregone.

The valve element 504 may be disposed within the bore 462 between a distal end 508 of the injector body and the outlet 482 of the bore 462. The valve element 504 may be a check valve that permits the flow of vapor from the bore 462 into the cylinders 438, 442 but prevents the flow of vapor from the cylinders 438, 442 into the injector bodies 458. In one configuration, the valve element 504 is a thin disk that is movable into an open position to permit the flow of intermediate-pressure vapor into the cylinders 438, 442 under the pressure created by the vacuum of the moving pistons 418, 422 within the respective cylinders 438, 442. Further, the valve element 504 may include at least one aperture 506 that allows the flow of intermediate-pressure vapor into the cylinders 438, 442 when the valve element 504 is moved into the open position.

In one configuration, a plurality of apertures 506 are organized in an annular ring within a diameter range that restricts fluid communication when abutting the distal end 508 (i.e., when the valve element 504 is in a closed position). When the valve element 504 abuts a shoulder 505 of bore 462, flow may proceed into cylinders 438, 442 via the apertures 506. The diameter range for the apertures 506 is within the inner diameter of passageway 466 and the inner diameter of shoulder 505 of bore 462, whereby the inner diameter of shoulder 505 is greater than the inner diameter of passageway 466. While the valve element 504 is described and shown as being a disk element, the valve element 504 could be any suitable valve such as, for example, a ball valve or a piston that allows flow of intermediate-pressure vapor from the bore 462 into the cylinders 438, 442 while preventing the flow of vapor from the cylinders 438, 442 into the injector bodies 458.

In operation, when one of the pistons 418, 422 is in the BDC position, one of the outlets 482 is open such that the vacuum created by the pistons 418, 422 moving within and relative to the cylinders 438, 442 exerts a force on the bore 462. The force exerted on the bore 462 moves the valve element 504 into an open position, thereby allowing intermediate-pressure vapor to flow from the conduit 450, into the injector body 458, and finally into the cylinders 438, 442 via the outlet 482. Once the piston 418, 422 begins to move from the BDC position to the TDC position, vapor disposed within the cylinder 438, 442 is compressed and may enter the bore 462 at the outlet 482 until the piston 418, 422 sufficiently closes the outlet 482. However, the pressurized vapor is not permitted to enter the injector body 458 as the valve element 504 is moved from the open state to the closed state due to the force exerted on the valve element 504 by the compressed vapor. Accordingly, the efficiency of the compressor 500 is improved, as none of the compressed vapor escapes the cylinders 438, 442 at the bores 462 when the pistons 418, 422 move from the BDC position to the TDC position.

While the valve elements 504 are shown as being spaced apart and separated from the outlets 482 of the respective bores 462, the valve elements 504 are preferably disposed as close as possible to the outlets 482 to prevent any pressurized vapor from escaping the cylinders 438, 442 when the pistons 418, 422 move from the BDC position to the TDC position. If the valve elements 504 were positioned along the bore 462 such that a gap extends between the valve element 504 and the outlet 482, such a gap would fill with pressurized vapor as the pistons 418, 422 move from the BDC position to the TDC position. This gap reduces the overall efficiency of the compressor assembly 500 by effectively increasing the volume of each cylinder 438, 442.

Figure 20:
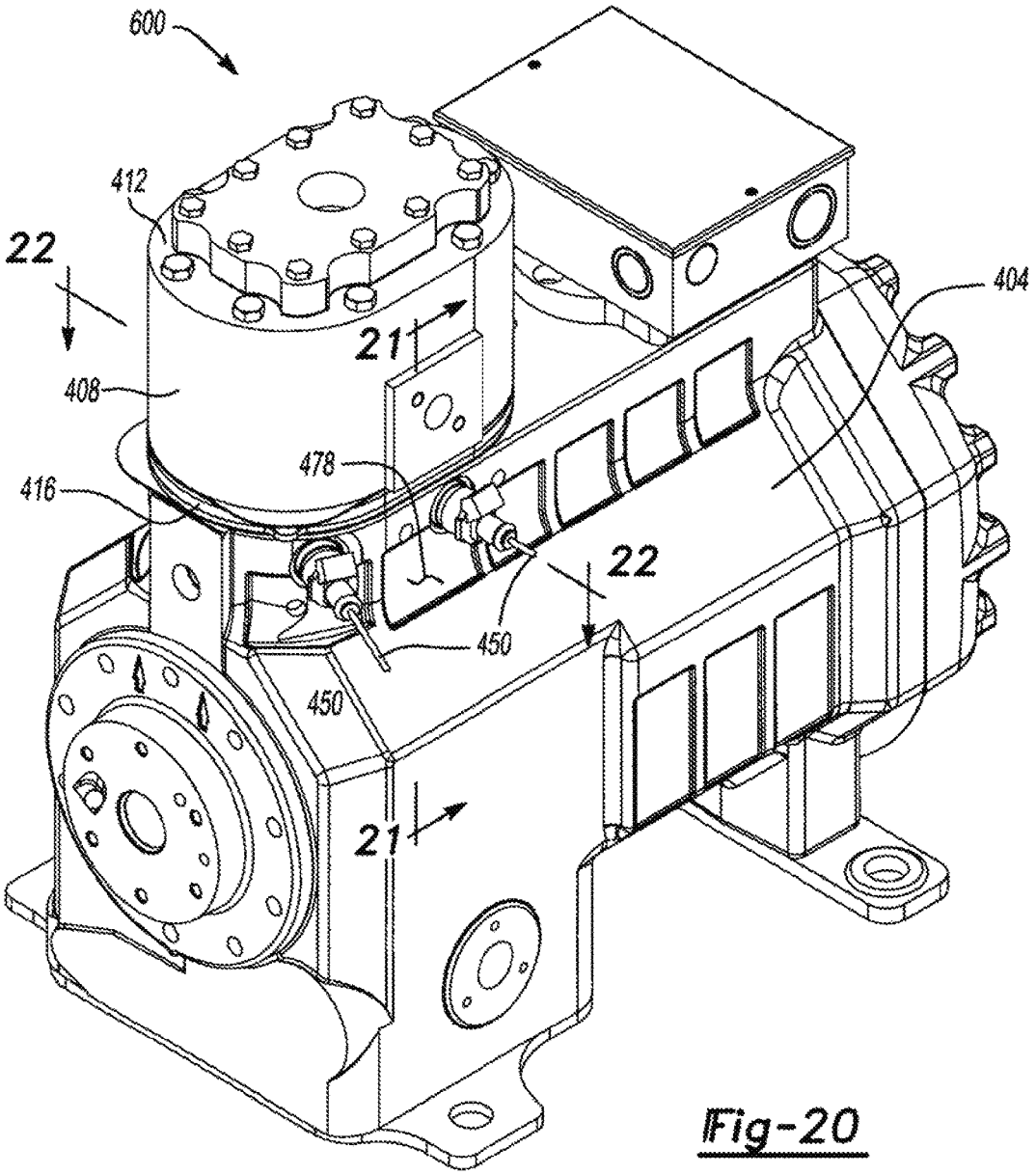
FIG. 20 is a perspective view of a compressor in accordance with the principles of the present disclosure.
Figure 21:
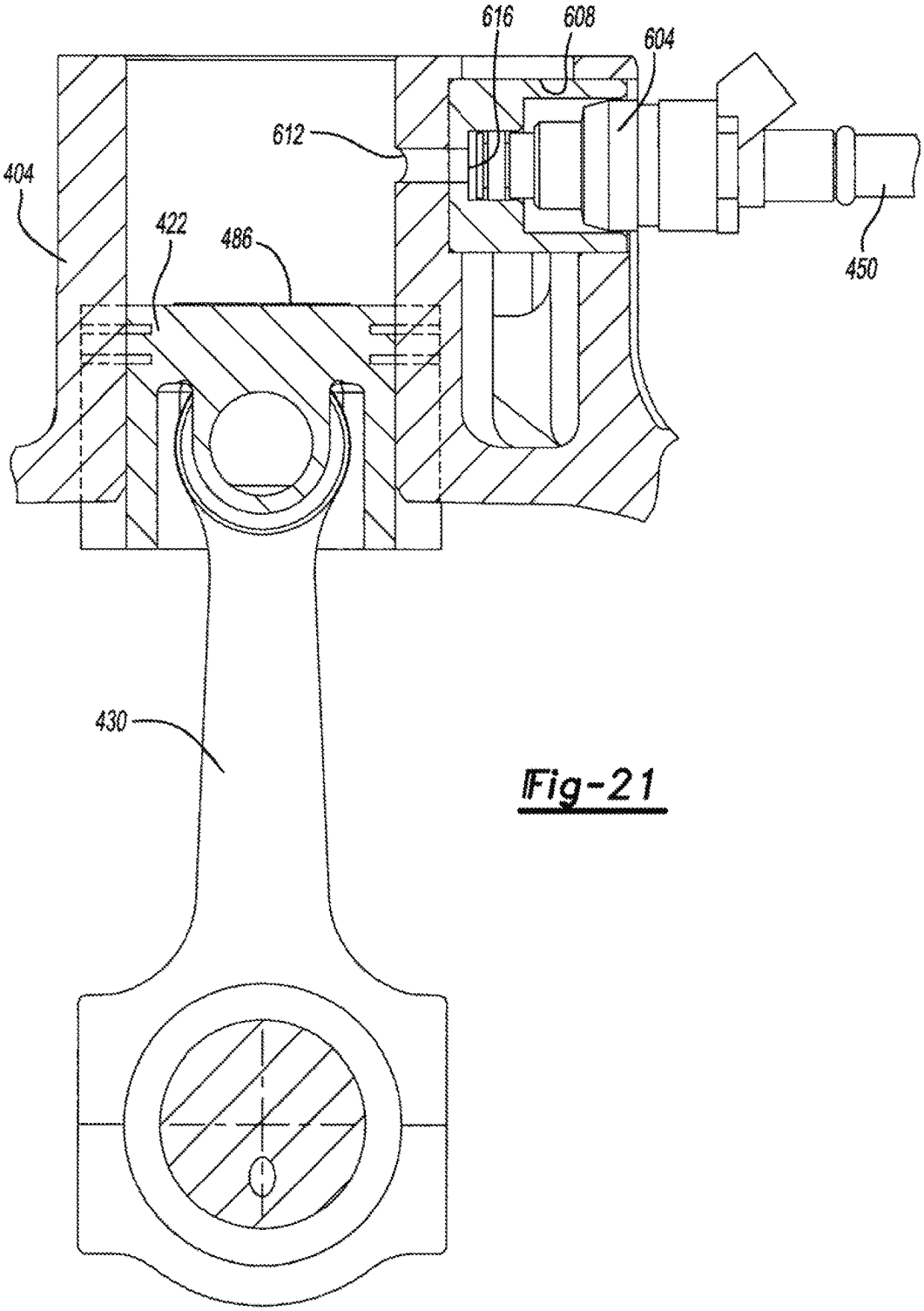
FIG. 21 is a partial cross-sectional view of the compressor of FIG. 20 taken along line 21-21.
Figure 22:
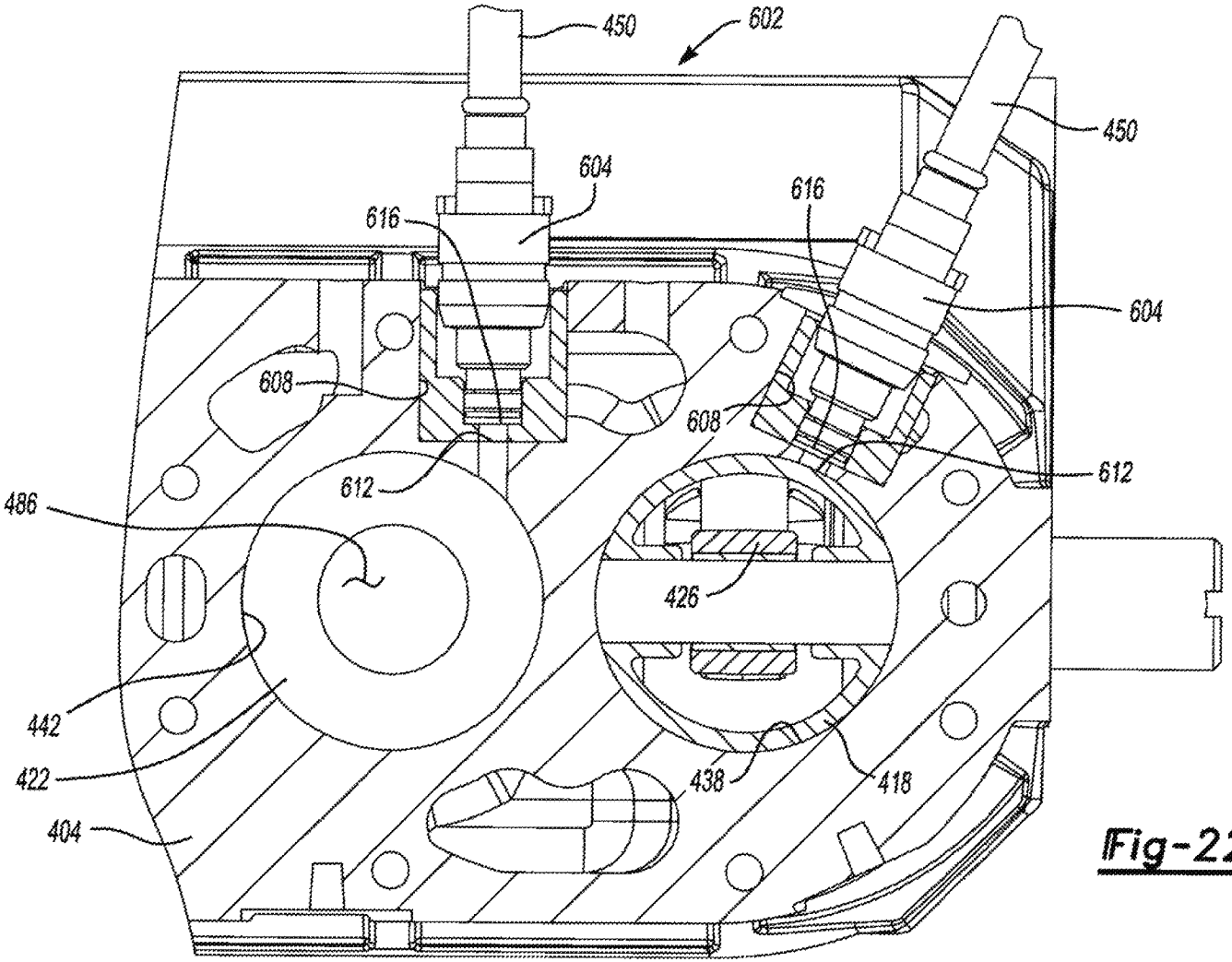
FIG. 22 is a partial cross-sectional view of the compressor of FIG. 20 taken along line 22-22.

With particular reference to FIGS. 20-22, a compressor assembly 600 is provided. The compressor assembly 600 is substantially similar to the compressor assembly 400 with the exception of a vapor-injection system 602. Specifically, the compressor assembly 600 incorporates the vapor-injection system 602 in place of the vapor-injection system 446 of the compressor assembly 400. In view of the substantial similarity in structure and function of the components associated with the compressor assembly 400 with respect to the compressor assembly 600, like reference numerals are used hereinafter and in the drawings to identify like components. Further, because the compressor assembly 600 operates in a similar fashion as the compressor assembly 400, a detailed description of operation of the compressor assembly 600 is foregone.

Figure 27:
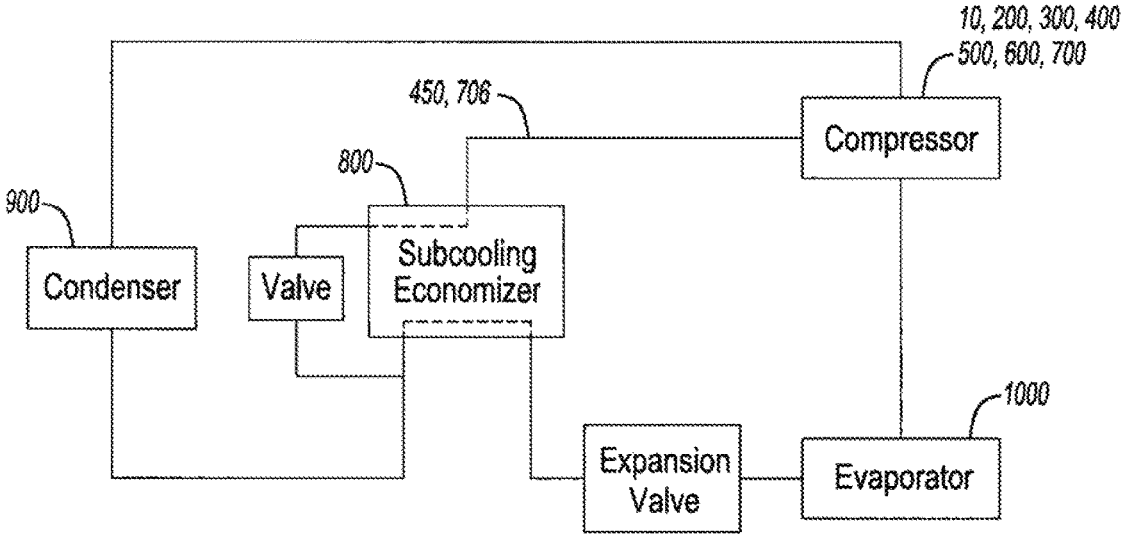
FIG. 27 is a schematic view of a refrigeration system.

The vapor-injection system 602 includes a series of injectors 604 that are fluidly coupled to respective conduits 450. As described above with respect to the vapor-injection system 446 of the compressor assemblies 400, 500, the conduits 450 supply intermediate-pressure gas from an external source such as a flash tank or economizer heat exchanger (FIG. 27). The injectors 604 receive the intermediate-pressure gas from the conduits 450 and selectively supply the intermediate-pressure gas to the cylinders 438, 442, as will be described below.

The injectors 604 are received in respective bores 608 formed in the compressor housing 404 and are positioned relative to the cylinders 438, 442 to allow the injectors 604 to selectively provide the cylinders 438, 442 with intermediate-pressure vapor. The bores 608 include an outlet 612 that allows the injectors 604 to be in fluid communication with the cylinders 438, 442. The injectors 604 are positioned within the bores 608 such that an outlet 616 of each injector is located as closely as possible to the outlet 612 of the bore 608.

In operation, the injectors 604 may be controlled to inject intermediate-pressure vapor at predetermined times during movement of the pistons 418, 422 relative to and within the cylinders 438, 442. Specifically, the injectors 604 may be actuated when one of the pistons 418, 422 are located in the BDC position such that intermediate-pressure vapor is provided to the cylinders 438, 442 when one of the pistons 418, 422 is in or is approaching the BDC position. The injectors 604 are closed prior to a predetermined amount of movement of the pistons 418, 422 from the BDC position to the TDC position to prevent pressurized vapor from entering any of the injectors 604. As described above, positioning the injector outlet 616 proximate to the outlet 612 of the bore 608 and preventing flow of pressurized vapor into the bore 608 increases the efficiency of the compressor assembly 600 in generating discharge-pressure gas.

Figure 23:
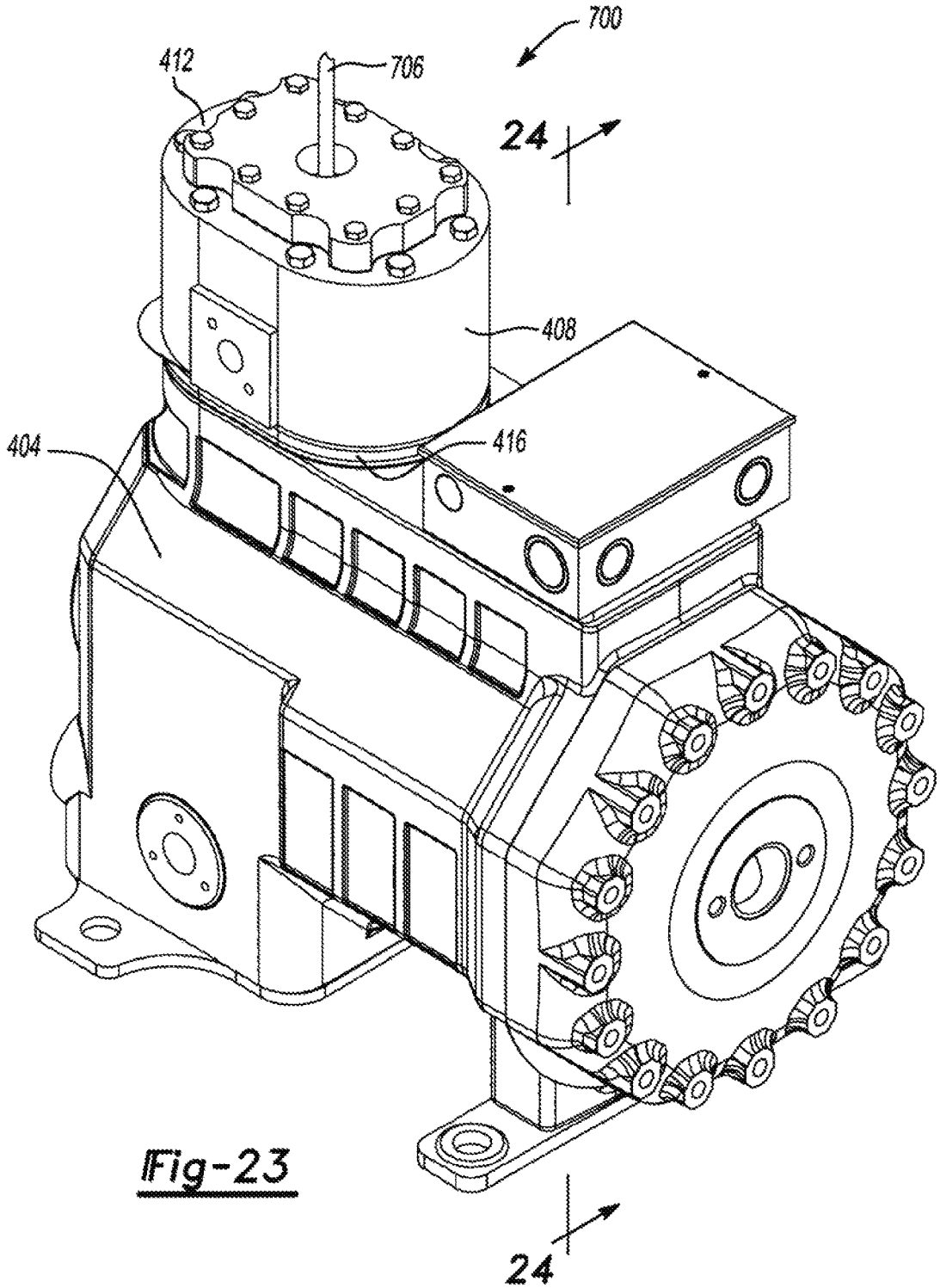
FIG. 23 is a perspective view of a compressor in accordance with the principles of the present disclosure.
Figure 24:
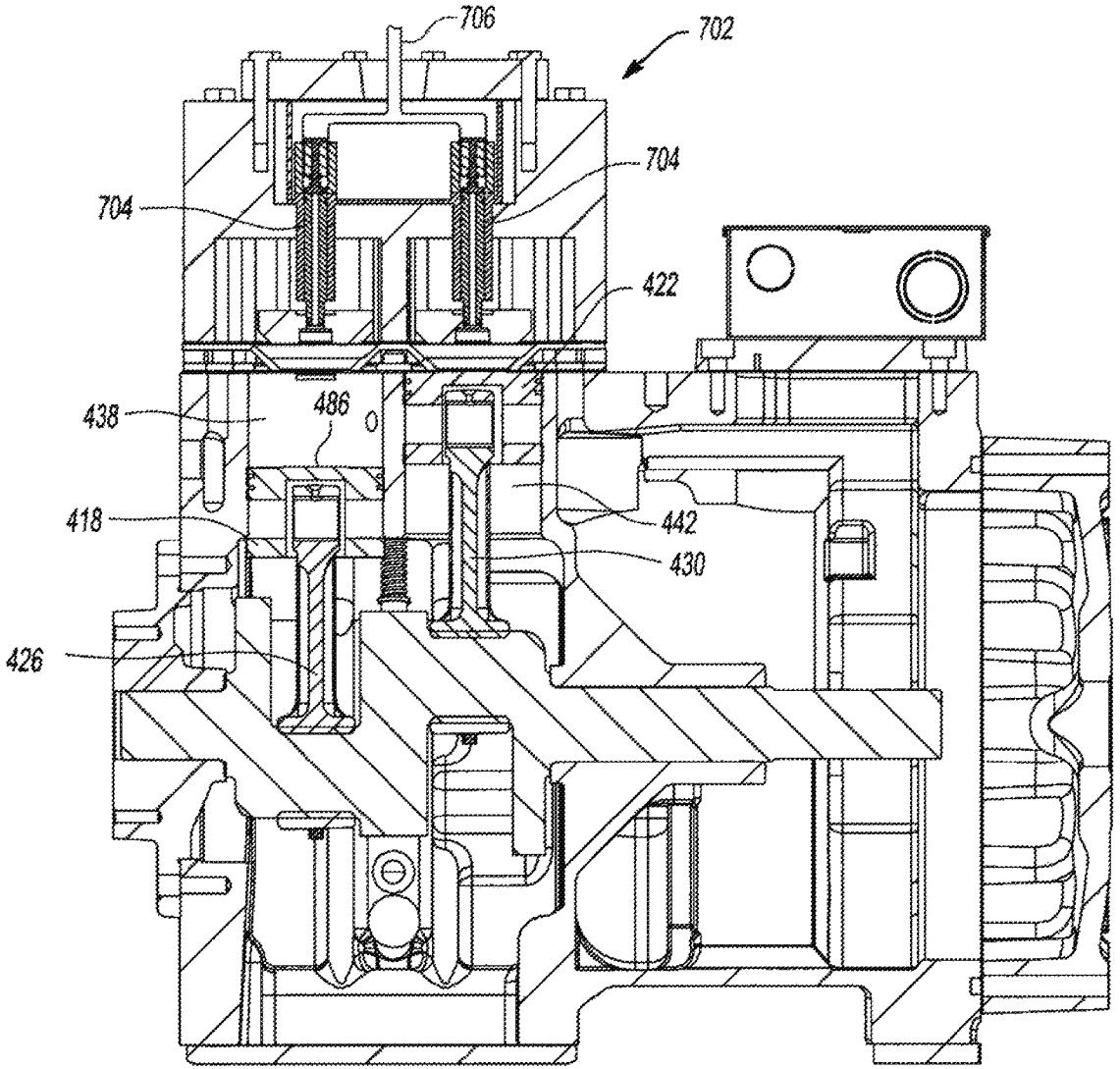
FIG. 24 is a cross-sectional view of the compressor of FIG. 23 taken along line 24-24.
Figure 25:
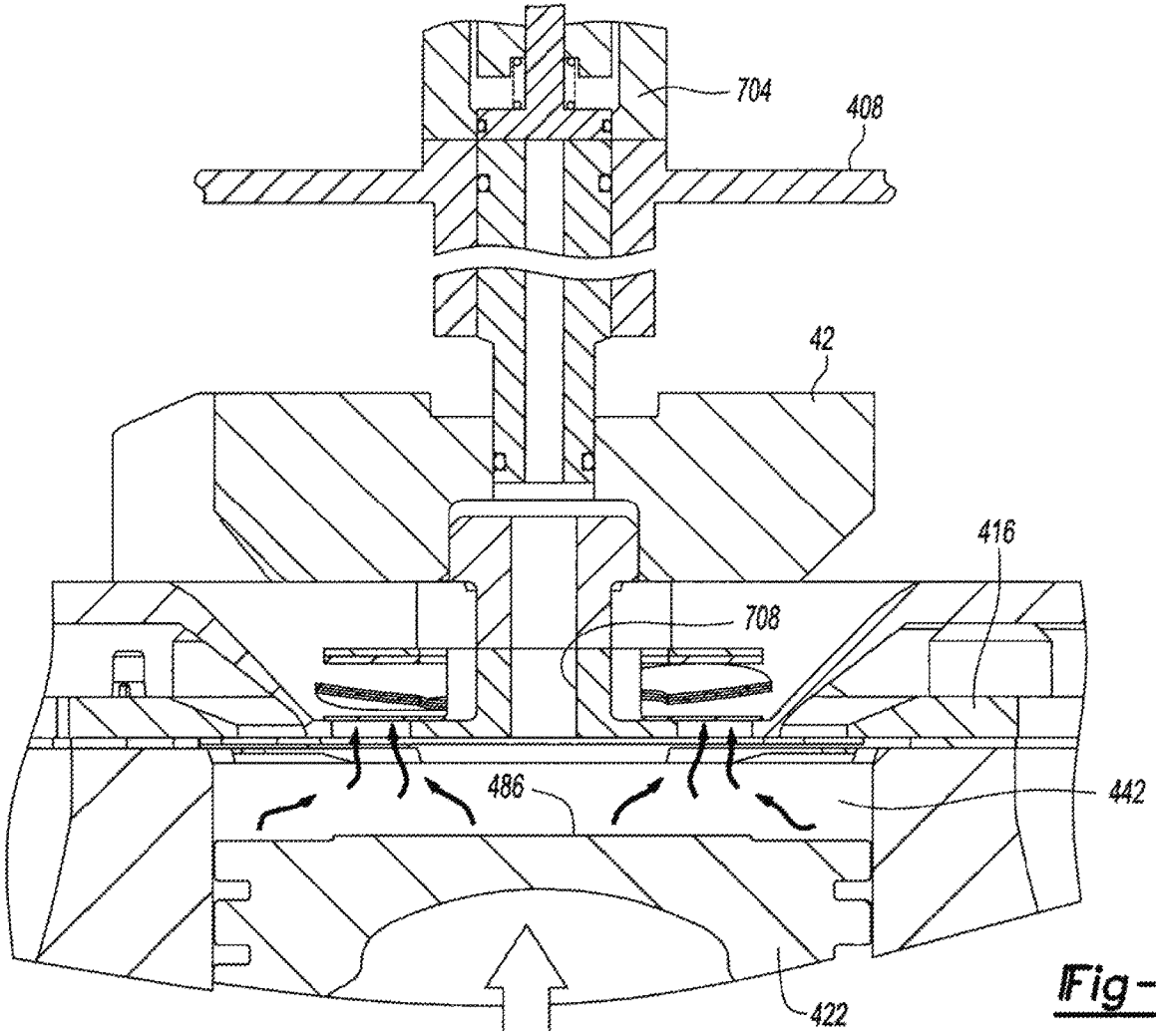
FIG. 25 is a partial cross-sectional view of the compressor of FIG. 23 showing a vapor injection valve located proximate to a cylinder head of the compressor.

With reference to FIGS. 23-25, a compressor assembly 700 is provided. The compressor assembly 700 is substantially similar to the compressor assembly 600 with the exception of a vapor-injection system 702 used in conjunction with the compressor assembly 700. Namely, the vapor-injection system 702 is used in conjunction with the compressor assembly 700 in place of the vapor-injection system 602 used in conjunction with the compressor assembly 600. In view of the substantial similarity in structure and function of the components associated with the compressor 400 with respect to the compressor 700, like reference numerals are used hereinafter and in the drawings to identify like components. Because operation of the compressor assembly 700 is similar to operation of the compressor 400, a description of operation of the compressor assembly 700 is foregone.

The vapor-injection system 702 includes a series of injectors 704 that are fluidly coupled to a conduit 706. The conduit 706 is similar to the conduit 450 in that the conduit 706 is in fluid communication with a source of intermediate-pressure vapor such as a flash tank or economizer heat exchanger (FIG. 27). The conduit 706 supplies the injectors 704 with intermediate-pressure vapor to allow the injectors 704 to selectively supply the cylinders 438, 442 with intermediate-pressure vapor.

The injectors 704 are in fluid communication with a bore 708 located proximate to a top of each cylinder 438, 442. Namely, the bore 708 is formed through the valve plate 416 to allow each injector 704 to be in fluid communication with a respective cylinder 438, 442.

As shown in FIGS. 24-25, the injectors 704 may be disposed within the cylinder head 408 and may extend from the cylinder head 408 in a direction toward each cylinder 438, 442. In operation, the injectors 704 may be selectively actuated to allow the injectors 704 to supply the cylinders 438, 442 with intermediate-pressure vapor from the conduit 706. Namely, the injectors 704 may be actuated from a closed state to an open state to inject intermediate-pressure vapor into the cylinders 438, 442 when one of the pistons 418, 422 is in or is approaching the BDC position.

Figure 26:
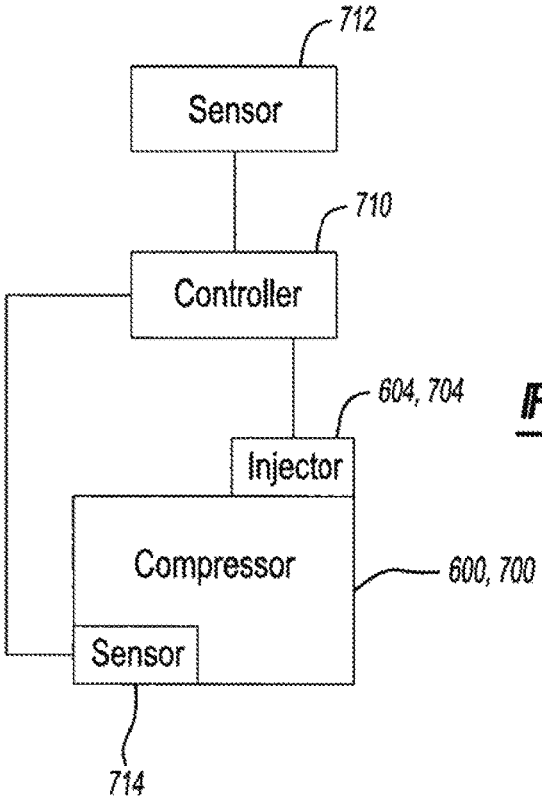
FIG. 26 is a schematic representation of a control system in accordance with the principles of the present disclosure.

With reference to FIG. 26, operation of the vapor-injection system 702 will be described in detail. While the vapor-injection system 702 will be described in conjunction with FIG. 26, the vapor-injection system 602 associated with the compressor assembly 600 could be controlled in a similar fashion.

The injectors 704 may be in communication with a controller 710 to allow the controller 710 to actuate the injectors 704 between the closed state and the open state. The controller 710 may control the injectors 704 based on information received from one or more sensors 712. The sensors 712 may include a pressure sensor located within the cylinders 438, 442 or a pressure sensor that is responsive to a pressure within the cylinders 438, 442 to allow the controller 710 to actuate the injectors 704 based on a pressure of one or both of the cylinders 438, 442. The controller 710 may additionally or alternatively be in communication with a sensor 714 associated with the crankshaft of the compressor assembly 700. The sensor 714 may be a sensor that determines a rotational position of the crankshaft and, thus, a position of the pistons 418, 422 within each cylinder 438, 442. In one configuration, the sensor 714 is a Hall Effect sensor that senses a rotational position of the crankshaft that is provided to the controller 710. The controller 710 may use the information provided by the sensor 714 to determine a position of the pistons 418, 422 within the respective cylinders 438, 442.

The controller 710 may utilize information from the sensors 712, 714 to determine when one of the pistons 418, 422 is located at the BDC position. When the controller 710 determines that one of the pistons 418, 422 is in the BDC position, the controller 710 may actuate the injector 704 to cause the injector 704 to supply intermediate-pressure vapor to the cylinder 438, 442 containing the piston 418, 422 located at the BDC position. The controller 710 will close the injectors 704 once the pistons 418, 422 located at the BDC position begins to move from the BDC position toward the TDC position at a predetermined time.

As described, the controller 710 can utilize the sensors 712, 714 together or independently from one another to determine a position of the pistons 418, 422 within the respective cylinders 438, 442 to optimize injection of intermediate-pressure vapor into the cylinders 438, 442. In one configuration, the controller 710 may rely on a pressure within the cylinders 438, 442 to determine a position of the pistons 418, 422 within each cylinder 438, 442 based on information from the sensor 712. In another configuration, the controller 710 may rely on information from the sensor 714 to determine a rotational position of the crankshaft and can then determine a position of each piston 418, 422 within the respective cylinders 438, 442. The controller 710 may rely on information from both sensors 712, 714 and may compare a position of the pistons 418, 422 determined based on information from the sensor 712 to a position of each piston 418, 422 determined based on information from the sensor 714 to verify that the information received from the sensors 712, 714 is accurate and indicates a position of the pistons 418, 422. Based on this information, the controller 710 may control the injectors 704 to optimize the injection of intermediate-pressure vapor into the cylinders 438, 442 when the pistons 418, 422 are at an optimum location to maximize compressor efficiency and output.

As set forth above and in reference to FIG. 27, the compressors 10, 200, 300, 400, 500, 600, 700 can be used in conjunction with a refrigeration system. The compressors 10, 200, 300, 400, 500, 600, 700 may be fluidly coupled to an economizer 800 as well as to a condenser 900 and an evaporator 1000. The discharge pressure gas generated by the particular compressor 10, 200, 300, 400, 500, 600, 700 is directed to the condenser 900 where the discharge pressure refrigerant changes phase from a vapor to a liquid. The liquid refrigerant is directed to the evaporator 100 where the refrigerant absorbs heat and changes state from a liquid to a gas. The suction pressure gas is then directed from the evaporator 1000 to the particular compressor 10, 200, 300, 400, 500, 600, 700 to once again elevate a pressure of the suction pressure gas to discharge pressure. The economizer 800 directs intermediate-pressure gas to the particular compressor 10, 200, 300, 400, 500, 600, 700 either via the conduit 450 for the compressors 10, 200, 300, 400, 500, 600 or via the conduit 706 for the compressor 700. Such intermediate-pressure gas may be selectively injected into the particular compressor 10, 200, 300, 400, 500, 600, 700 to improve the efficiency of the compressor 10, 200, 300, 400, 500, 600, 700.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compression cylinder;

a compression piston disposed within said compression cylinder and operable to compress a vapor disposed within said compression cylinder from a suction pressure to a discharge pressure;

a crankshaft operable to cycle said compression piston within said compression cylinder;

an injection bore in fluid communication with said compression cylinder and operable to selectively communicate intermediate-pressure vapor at a pressure between said suction pressure and said discharge pressure to said compression cylinder;

a position sensor measuring a rotational position of said crankshaft; and a valve assembly associated with said injection bore, said valve assembly operable to control passage of fluid from said injection bore into said compression cylinder in response to data provided by said position sensor.

2. The compressor of claim 1, wherein said compression piston is movable within said compression cylinder between a top dead center (TDC) position and a bottom dead center (BDC) position, wherein said injection bore communicates with said compression cylinder through a bore having an outlet in a cylindrical wall of said compression cylinder, said outlet being axially aligned with a top surface of said compression piston when said compression piston is in said BDC position, such that when said compression piston is in said BDC position, said top surface of said compression piston and at least a portion of said outlet are equidistant from said TDC position along a longitudinal axis of said compression cylinder, and wherein said compression piston exposes said injection bore in said BDC position and blocks said injection bore in said TDC position.

3. The compressor of claim 2, wherein said injection bore is partially blocked by said compression piston when said compression piston is in said BDC position.

4. The compressor of claim 2, wherein said injection bore is fully exposed when said compression piston is in said BDC position.

5. The compressor of claim 1, wherein said compression piston is movable within said compression cylinder between a top dead center (TDC) position and a bottom dead center (BDC) position, and wherein said injection bore communicates with said compression cylinder for the first half of piston travel from BDC to TDC.

6. The compressor of claim 1, further comprising a controller in communication with said position sensor and said valve assembly and operable to control said valve assembly between an open state injecting said intermediate-pressure vapor into said compression cylinder and a closed state preventing injection of said intermediate-pressure vapor into said compression cylinder.

7. The compressor of claim 6, further comprising a pressure sensor measuring a pressure within said compression cylinder and in communication with said controller, wherein said controller controls said valve assembly based on data from said pressure sensor and the data from said position sensor.

8. The compressor of claim 1, wherein said injection bore communicates with said compression cylinder for 90 degrees of crankshaft rotation.

9. The compressor of claim 1, further comprising a cylinder head disposed at an axial end of said compression cylinder, wherein said injection bore is disposed in said cylinder head.

10. The compressor of claim 1, wherein said injection bore is disposed in a compressor housing in which said compression cylinder is formed.

11. The compressor of claim 1, wherein said injection bore communicates said intermediate-pressure vapor to said compression cylinder when said compression piston exposes said injection bore, and wherein said injection bore is prevented from communicating said intermediate-pressure vapor to said compression cylinder when said compression piston blocks said injection bore.

12. A compressor comprising:

a compression cylinder;

a compression piston disposed within said compression cylinder and operable to compress a vapor disposed within said compression cylinder from a suction pressure to a discharge pressure;

a crankshaft operable to cycle said compression piston within said compression cylinder;

an injection bore in fluid communication with said compression cylinder and operable to selectively communicate intermediate-pressure vapor at a pressure between said suction pressure and said discharge pressure to said compression cylinder;

an injector disposed within said injection bore and operable to inject fluid into said compression cylinder;

a controller in communication with said injector and operable to control said injector between an open state injecting said intermediate-pressure vapor into said compression cylinder and a closed state preventing injection of said intermediate-pressure vapor into said compression cylinder; and a position sensor in communication with said controller and measuring a rotational position of said crankshaft, said controller controlling said injector in response to data provided by said position sensor.

13. The compressor of claim 12, wherein said compression piston is movable within said compression cylinder between a top dead center (TDC) position and a bottom dead center (BDC) position, wherein said injection bore communicates with said compression cylinder through a bore having an outlet in a cylindrical wall of said compression cylinder, said outlet being axially aligned with a top surface of said compression piston when said compression piston is in said BDC position, such that when said compression piston is in said BDC position, said top surface of said compression piston and at least a portion of said outlet are equidistant from said TDC position along a longitudinal axis of said compression cylinder, and wherein said compression piston exposes said injection bore in said BDC position and blocks said injection bore in said TDC position.

14. The compressor of claim 13, wherein said injection bore is partially blocked by said compression piston when said compression piston is in said BDC position.

15. The compressor of claim 12, wherein said injection bore communicates with said compression cylinder for 90 degrees of crankshaft rotation.

16. The compressor of claim 12, further comprising a pressure sensor measuring a pressure within said compression cylinder and in communication with said controller, wherein said controller controls said injector based on data from said position sensor and said pressure sensor.

17. The compressor of claim 12, further comprising a cylinder head disposed at an axial end of said compression cylinder, wherein said injector is disposed in said cylinder head.

18. The compressor of claim 12, wherein said injector is disposed in a compressor housing in which said compression cylinder is formed.

19. The compressor of claim 12, wherein said injector is in fluid communication with an economizer.

20. The compressor of claim 12, wherein said injection bore communicates said intermediate-pressure vapor to said compression cylinder when said compression piston exposes said injection bore, and wherein said injection bore is prevented from communicating said intermediate-pressure vapor to said compression cylinder when said compression piston blocks said injection bore.

21. A compressor comprising:

a compression cylinder;

a compression piston disposed within said compression cylinder and operable to compress a vapor disposed within said compression cylinder from a suction pressure to a discharge pressure;

a crankshaft operable to cycle said compression piston within said compression cylinder;

an injection bore in fluid communication with said compression cylinder and operable to selectively communicate intermediate-pressure vapor at a pressure between said suction pressure and said discharge pressure to said compression cylinder;

an injector disposed within said injection bore and operable to inject fluid into said compression cylinder; and a controller in communication with said injector and operable to control said injector between an open state injecting said intermediate-pressure vapor into said compression cylinder and a closed state preventing injection of said intermediate-pressure vapor into said compression cylinder, wherein said compression piston is movable within said compression cylinder between a top dead center (TDC) position and a bottom dead center (BDC) position, and wherein said injection bore communicates with said compression cylinder for the first half of piston travel from BDC to TDC.

22. A compressor comprising:

a compression cylinder;

a compression piston disposed within said compression cylinder and operable to compress a vapor disposed within said compression cylinder from a suction pressure to a discharge pressure;

a crankshaft operable to cycle said compression piston within said compression cylinder;

an injection bore in fluid communication with said compression cylinder and operable to selectively communicate intermediate-pressure vapor at a pressure between said suction pressure and said discharge pressure to said compression cylinder;

an injector disposed within said injection bore and operable to inject fluid into said compression cylinder;

a controller in communication with said injector and operable to control said injector between an open state injecting said intermediate-pressure vapor into said compression cylinder and a closed state preventing injection of said intermediate-pressure vapor into said compression cylinder; and a pressure sensor measuring a pressure within said compression cylinder and in communication with said controller, wherein said controller controls said injector based on data from said pressure sensor.

* * * * *